US008644717B2

(12) United States Patent
Mori

(10) Patent No.: US 8,644,717 B2
(45) Date of Patent: Feb. 4, 2014

(54) IMAGE FORMING APPARATUS AND METHOD FOR DOUBLE-SIDED PRINTING

(75) Inventor: Tetsunori Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 864 days.

(21) Appl. No.: 12/130,004

(22) Filed: May 30, 2008

(65) Prior Publication Data

US 2008/0298821 A1 Dec. 4, 2008

(30) Foreign Application Priority Data

May 31, 2007 (JP) ..... 2007-144512

(51) Int. Cl.
*B41J 2/01* (2006.01)

(52) U.S. Cl.
USPC ..... 399/21; 347/102; 347/16

(58) Field of Classification Search
USPC ..... 347/102
See application file for complete search history.

(56) References Cited

U.S. PATENT DOCUMENTS

| | | | | |
|---|---|---|---|---|
| 6,652,060 | B2 * | 11/2003 | Uchida | 347/16 |
| 6,719,469 | B2 * | 4/2004 | Yasui et al. | 400/603 |
| 2004/0179053 | A1 | 9/2004 | Itoh | |
| 2005/0073535 | A1 | 4/2005 | Seki et al. | |
| 2005/0275672 | A1 * | 12/2005 | Koshikawa | 347/5 |
| 2006/0279622 | A1 * | 12/2006 | Kao | 347/104 |
| 2007/0030299 | A1 * | 2/2007 | Izuchi | 347/16 |

FOREIGN PATENT DOCUMENTS

| | | | | |
|---|---|---|---|---|
| JP | 09052397 A | * | 2/1997 | B41J 2/01 |
| JP | H09-052397 A | | 2/1997 | |
| JP | H11-348247 A | | 12/1999 | |
| JP | 2000001010 A | | 1/2000 | |
| JP | 2001001549 A | | 1/2001 | |
| JP | 2004276264 A | | 10/2004 | |
| JP | 2005-125750 A | | 5/2005 | |
| JP | 2005-349710 A | | 12/2005 | |
| JP | 2007-021945 A | | 2/2007 | |

OTHER PUBLICATIONS

Machine Translation of Terao (JP 09052397 A), JPO, Aug. 2, 2011.*
Japan Patent Office, Notification of Reason for Refusal for Japanese Patent Application No. 2007-144512 (counterpart to above-captioned patent application), dispatched Nov. 8, 2011.
Japan Patent Office, Notification of Reason for Refusal for Japanese Patent Application No. 2007-144512 (counterpart Japanese patent application), dispatched Mar. 19, 2013.

* cited by examiner

*Primary Examiner* — Nguyen Ha
(74) *Attorney, Agent, or Firm* — Baker Botts L.L.P.

(57) ABSTRACT

An image forming apparatus and a method are provided. The apparatus includes an image forming unit that discharges ink; a transfer unit that performs a first conveying operation of conveying the sheet in a state in which a first surface thereof faces the image forming unit, and a second conveying operation of conveying the sheet in a state in which a second surface thereof faces the image forming unit after the first conveying operation; a detecting unit that detects a jam of the sheet subjected to the second conveying operation; a setting unit that sets a dry time for drying the ink; and a control unit that controls the transfer unit to start the second conveying operation after the dry time has elapsed after the first conveying operation, wherein the setting unit sets the dry time for a current sheet based on the detection result of a previous sheet.

11 Claims, 13 Drawing Sheets

| | INK AMOUNT | DRY TIME | JAM OCCURRENCE |
|---|---|---|---|
| FIRST | 55 | 100 | NO |
| SECOND | 55 | 95 | NO |
| THIRD | 55 | 90 | YES |
| FOURTH | 55 | 95 | NO |
| FIFTH | 45 | 85 | NO |
| SIXTH | 75 | 110 | NO |
| SEVENTH | 55 | 95 | NO |
| ⋮ | ⋮ | ⋮ | ⋮ |

FIG. 8A

35

DEFAULT TIME TABLE

| INK AMOUNT | DEFAULT TIME |
|---|---|
| 0-10 | $T_0$ |
| 10-20 | $T_1$ |
| 20-30 | $T_2$ |
| ⋮ | ⋮ |
| 80-90 | $T_9$ |
| 90-100 | $T_{10}$ |

FIG. 8B

36

SHORTEST TIME TABLE

| INK AMOUNT | SHORTEST TIME |
|---|---|
| 0-10 | $T_A$ |
| 10-20 | $T_B$ |
| 20-30 | $T_C$ |
| ⋮ | ⋮ |
| 80-90 | $T_J$ |
| 90-100 | $T_K$ |

FIG. 8C

37

LIMIT TIME TABLE

| INK AMOUNT | LIMIT TIME |
|---|---|
| 0-10 | $T_I$ |
| 10-20 | $T_{II}$ |
| 20-30 | $T_{III}$ |
| ⋮ | ⋮ |
| 80-90 | $T_{IX}$ |
| 90-100 | $T_X$ |

FIG. 9

| | INK AMOUNT | DRY TIME | JAM OCCURRENCE |
|---|---|---|---|
| FIRST | 55 | 100 | NO |
| SECOND | 55 | 95 | NO |
| THIRD | 55 | 90 | YES |
| FOURTH | 55 | 95 | NO |
| FIFTH | 45 | 85 | NO |
| SIXTH | 75 | 110 | NO |
| SEVENTH | 55 | 95 | NO |
| ⋮ | ⋮ | ⋮ | ⋮ |

IMAGE FORMING APPARATUS AND METHOD FOR DOUBLE-SIDED PRINTING

CROSS REFERENCE TO RELATED APPLICATION

The present application claims priority from Japanese Patent Application No. 2007-144512, which was filed on May 31, 2007, the disclosure of which is herein incorporated by reference in its entirety.

TECHNICAL FIELD

Apparatuses and devices consistent with the present invention relate to image forming apparatuses and, more particularly, to image forming apparatuses which include an image forming unit that discharges ink onto a sheet conveyed along a transfer path to form images on both surfaces of the sheet.

BACKGROUND

Japanese unexamined patent application publication No. JP-A-2000-1010 describes a related art double-sided inkjet image forming apparatus. The related art double-sided inkjet image forming apparatus is configured to form images on both surfaces of a recording sheet. In the related art double-sided image forming apparatus, the recording sheet fed from a sheet feed tray is conveyed along a transfer path, and an inkjet head discharges ink onto the recording sheet while the recording sheet is conveyed. Accordingly, an image is recorded on one surface (e.g., a front surface) of the recording sheet. The double-sided image forming apparatus switches back and conveys the recording sheet and discharges ink from the inkjet head to the recording sheet while conveying the recording sheet. In this way, the double-sided image forming apparatus records an image on the other surface (e.g., a rear surface) of the recording sheet. The recording sheet having images formed on both surfaces is then discharged to a sheet discharging tray.

The related art double-sided image forming apparatus is provided with a unit for drying ink droplets adhered to the surface of the recording sheet.

The related art inkjet image forming apparatus discharges the recording sheet having an image formed on the front surface thereof to the outside once. Then, the related art inkjet image forming apparatus determines whether a dry time has elapsed after image forming on the front surface has been completed. The dry time allows the ink droplets adhered to the front surface of the recording sheet to dry, and depends on the amount of ink adhered to the front surface of the recording sheet. If it is determined that the dry time has elapsed, the recording sheet is fed into the apparatus again, and an image is formed on the rear surface of the recording sheet.

However, the time required to dry the ink droplets adhered to the front surface of the recording sheet depends on many factors, such as the kind of recording sheet, temperature, and humidity as well as the amount of ink adhered to the recording sheet. Therefore, the related art inkjet image forming apparatus has disadvantages in that the dry time is difficult to set, and if the dry time is incorrectly set, a recording sheet is fed again without being completely dried or a recording sheet is not fed again even though the recording sheet has been completely dried. The incorrect dry time thus results in bleed-through on the sheet which has not dried and resulting degradation of image quality, or an increased printing time for the double-sided sheet.

SUMMARY

Accordingly, it is an aspect of the present invention to provide a double-sided image forming apparatus capable of more accurately setting a dry time.

Exemplary embodiments of the present invention address the above disadvantages and other disadvantages not described above. However, the present invention is not required to overcome the disadvantages described above, and thus, an exemplary embodiment of the present invention may not overcome any of the problems described above.

According to an illustrative aspect of the present invention, there is provided an image forming apparatus comprising an image forming unit that discharges ink onto a sheet to form an image on the sheet; a transfer unit that performs a first conveying operation of conveying the sheet in a state in which a first surface thereof faces the image forming unit and a second conveying operation of conveying the sheet in a state in which a second surface thereof faces the image forming unit after the first conveying operation; a detecting unit that detects a jam of the sheet subjected to the second conveying operation; a setting unit that sets a dry time for drying the ink discharged onto the first surface of the sheet by the image forming unit; and a control unit that controls the transfer unit to start the second conveying operation after the dry time has elapsed after the first conveying operation, wherein the setting unit sets the dry time for a current sheet on a basis of a detection result of a previous sheet.

According to another exemplary embodiment of the present invention, there is provided a method comprising conveying a first sheet through a first conveyance path; printing an first image on a first surface of the first sheet; reading a dry time for the first sheet; waiting for the dry time to elapse; conveying the first sheet to a second conveyance path; determining whether the first sheet is jammed; printing a second image on a second surface of the first sheet; and setting a dry time for a second sheet based on the determination of whether the first sheet jammed.

BRIEF DESCRIPTION OF THE DRAWINGS

Illustrative aspects of the invention will be described in detail with reference to the following figures wherein:

FIGS. 8A to 8C are diagrams illustrating a default time table, a shortest time table, and a limit time table, respectively;

FIG. 9 is a diagram illustrating an example of changing the setting of a dry time;

DETAILED DESCRIPTION OF EXEMPLARY EMBODIMENTS OF THE PRESENT INVENTION

Hereinafter, exemplary embodiments of the invention will be described with reference to the accompanying drawings. The embodiments of the invention are merely illustrative, and various modifications and changes to the invention can be made without departing from the scope and spirit of the invention.

<Multifunction Device>

Figure 1:
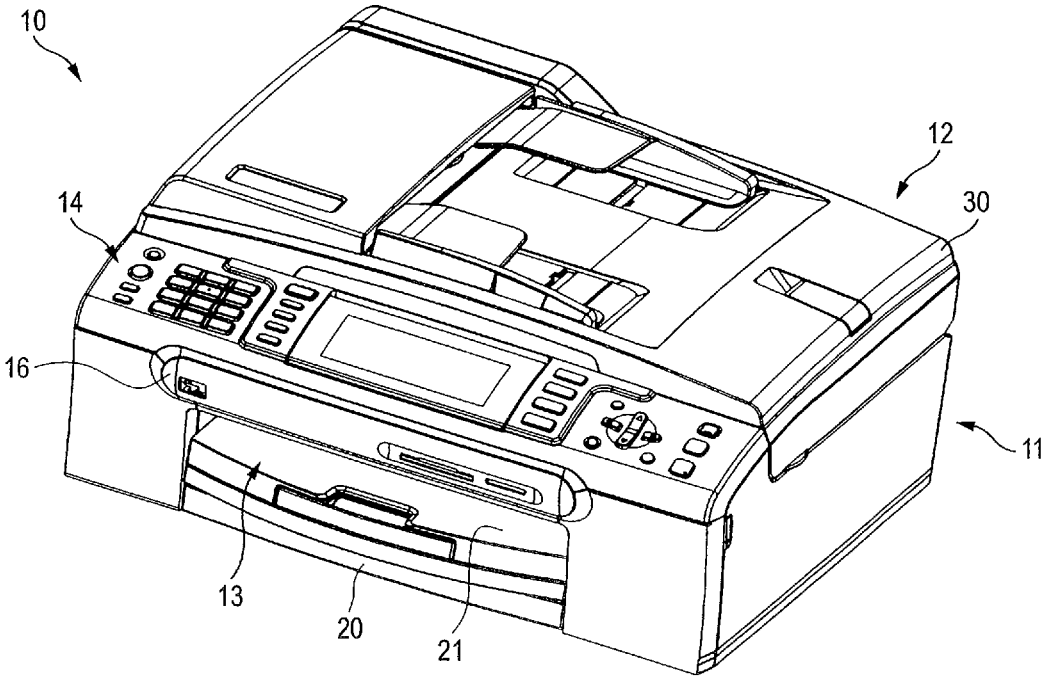
FIG. 1 is a perspective view illustrating a multifunction device according to an exemplary embodiment of the present invention.
Figure 2:
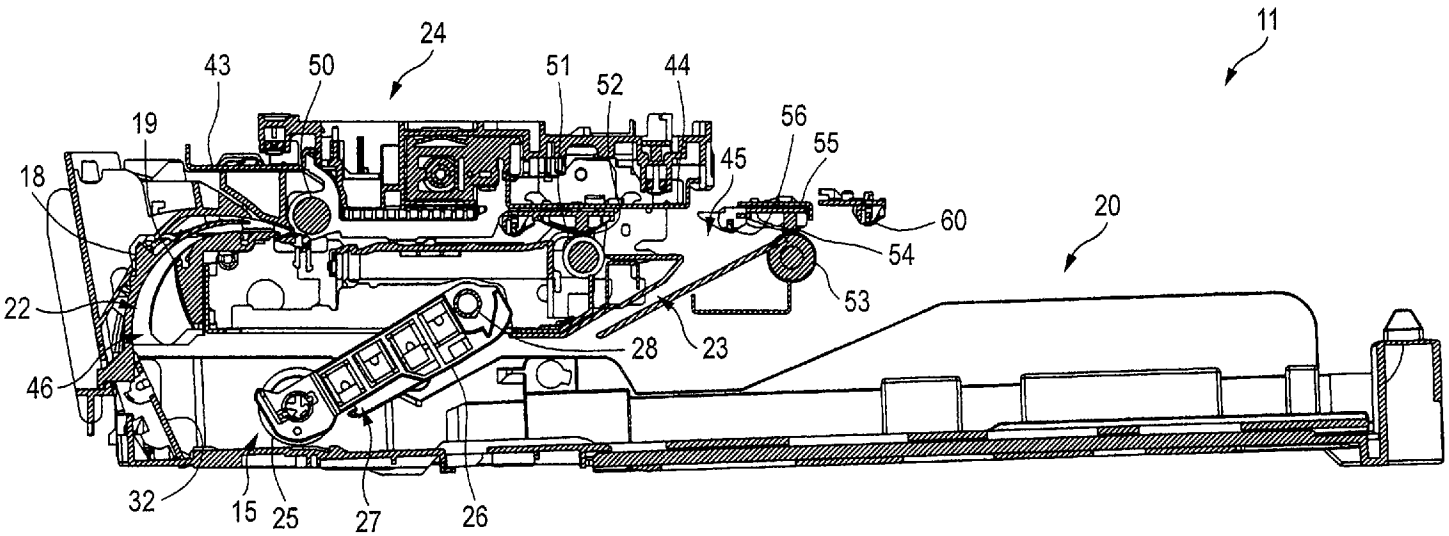
FIG. 2 is a longitudinal cross-sectional view illustrating an internal structure of the multifunction device of FIG. 1.

FIG. 1 is a perspective view illustrating a multifunction device according to an exemplary embodiment of the present invention, and FIG. 2 is a longitudinal cross-sectional view illustrating an internal structure of a printer 11 of the multifunction device 10.

The multifunction device (MDF) 10 includes the printer 11 and a scanner 12, and has a print function, a scan function, a copy function, and a facsimile function. A double-sided image forming apparatus according to an exemplary embodiment of the present invention serves as the printer 11 of the multifunction device 10. Therefore, the following description will be focused on the print function of the multifunction device 10.

As shown in FIG. 1, the printer 11 is provided in a lower part of the multifunction device 10. As shown in FIG. 2, a first transfer path 22 and a second transfer path 23 are formed inside the printer 11. The printer 11 includes a sheet feed tray 20, a transfer unit 15, an image forming unit 24, and a sheet discharging tray 21 (see FIG. 1). The sheet feed tray 20 stores recording sheets used for image printing. The transfer unit 15 conveys the recording sheets along the first transfer path 22 and the second transfer path 23. The image forming unit 24 discharges ink onto the recording sheet conveyed along the first transfer path 22 to form images on the recording sheet. The recording sheet having the images formed by the image forming unit 24 thereon is discharged to the sheet discharging tray 21.

The multifunction device 10 can form images on both front and rear surfaces of the recording sheet. When images are formed on both surfaces of the recording sheet, an image is formed on the front surface of the recording sheet, and the recording sheet is guided from the first transfer path 22 to the second transfer path 23. Then, the recording sheet is conveyed from the second transfer path 23 to the first transfer path 22 again, so that the front and rear surfaces are reversed. Then, the image forming unit 24 forms an image on the rear surface of the reversed recording sheet.

As shown in FIG. 1, the scanner 12 is provided at an upper part of the multifunction device 10. The scanner 12 includes a flat bed scanner (FBS) and an automatic document feeder (ADF), both of which are not specifically shown. As shown in FIG. 1, a document cover 30, serving as a top board of the multifunction device 10, is openably provided. The ADF is provided in the document cover 30. Although not shown in FIG. 1, a platen glass and an image sensor are provided below the document cover 30. In the scanner 12, the image sensor scans the image of the document loaded on the platen glass, or the image of the document conveyed by the ADF. The printer 11 generates print data required for double-sided image forming on the basis of the image data of the document scanned by the scanner 12.

A control panel 14 is provided at an upper front side of the multifunction device 10. The control panel 14 is for operating the printer 11 or the scanner 12. The control panel 14 includes a liquid crystal display for displaying various information items and input keys for inputting information.

The multifunction device 10 includes a slot unit 16. Various small memory cards, which are storage media, can be inserted into the slot unit 16. When the control panel 14 is operated to perform a predetermined operation with a small memory card inserted into the slot unit 16, image data is read from the small memory card, and then the printer 11 forms an image, corresponding to the image data, on the recording sheet.

<Printer>

Next, the configuration of the printer 11 will be described in detail.

As shown in FIG. 1, an opening 13 is formed in the front surface of the printer 11. The sheet feed tray 20 and the sheet discharging tray 21 are provided inside the opening 13 in a two-stage structure in the vertical direction. As shown in FIG. 2, the printer 11 includes the sheet feed tray 20, a feed roller 25, an arm 26, and a power transmission mechanism 27. In FIG. 2, the sheet discharging tray 21 is not shown.

Figure 3:
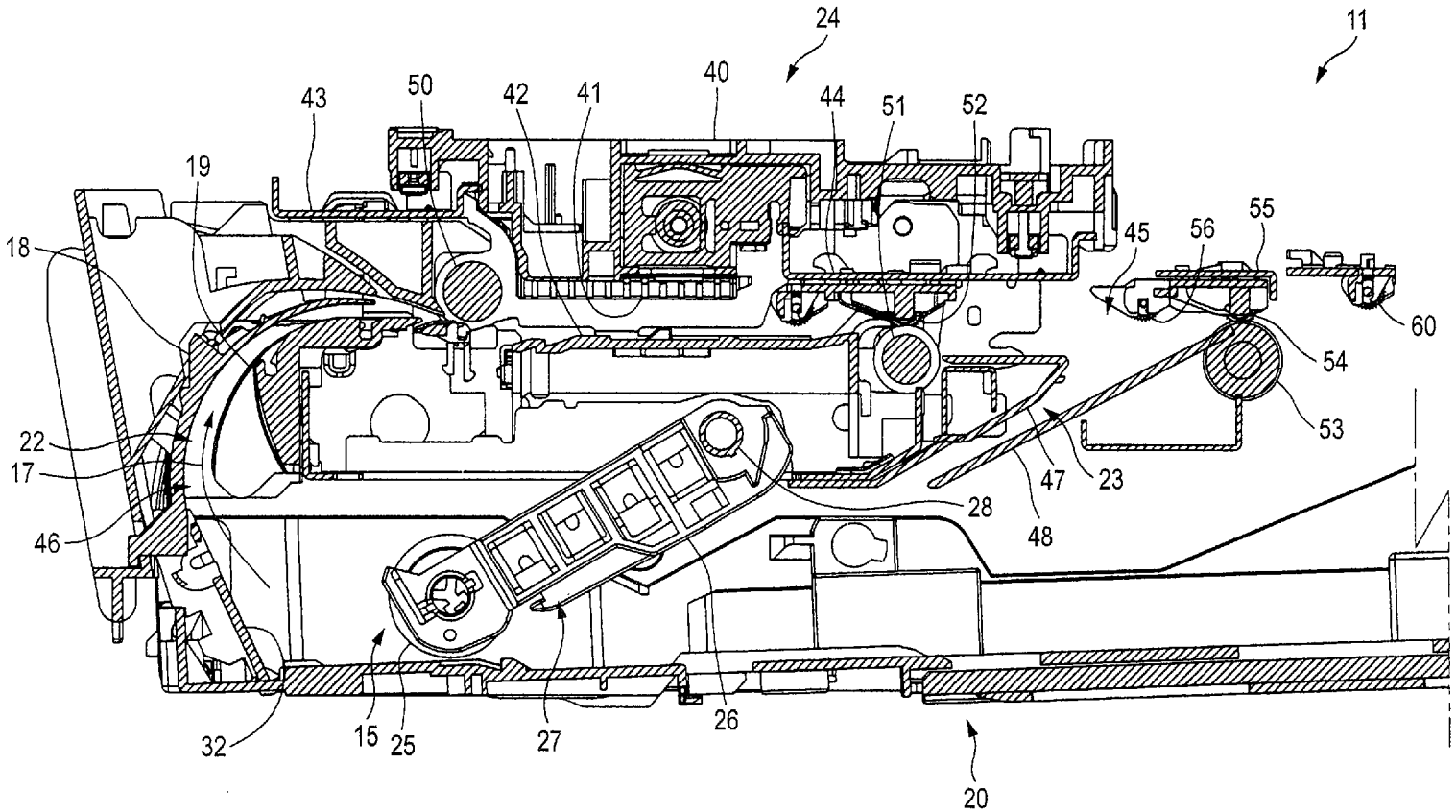
FIG. 3 is an enlarged cross-sectional view of the multifunction device of FIG. 2.

FIG. 3 is an enlarged cross-sectional view illustrating the printer 11 of the multifunction device 10.

As shown in FIGS. 2 and 3, the feed roller 25 is provided above the sheet feed tray 20. The feed roller 25 feeds the recording sheets loaded on the sheet feed tray 20 to the first transfer path 22. The feed roller 25 is rotatably supported by the leading end of the arm 26. The feed roller 25 is driven and rotated by a driving force that is transmitted from an LF motor 77 (see FIG. 6), which is a driving source, through the power transmission mechanism 27. The power transmission mechanism 27 includes a plurality of gears that are engaged in series with each other.

The arm 26 is supported by a base shaft 28. The base of the arm 26 is supported by the base shaft 28. In this way, the arm 26 can rotate on the base shaft 28. This rotation enables the arm 26 to move up and down so as to come into contact with or be separated from the sheet feed tray 20. The arm 26 is pivoted and urged downward by its own weight or a spring. A cam follower that rotates the arm 26 upward is formed in the side wall of the sheet feed tray 20. In this way, when the sheet feed tray 20 is inserted, the arm 26 is moved upward.

When the arm 26 is pivoted and urged downward, the teed roller 25 comes into pressure contact with the recording sheet on the sheet feed tray 20. In this state, when the feed roller 25 is rotated, the uppermost recording sheet is conveyed to an inclined plate 32 by a friction force between a roller surface of the feed roller 25 and the recording sheet. When the leading end of the recording sheet comes into contact with the inclined plate 32, the uppermost one of a bundle of recording sheets is guided upward.

<First Transfer Path>

The first transfer path 22 is provided above the inclined plate 32. The first transfer path 22 is curved in a U shape that extends upward from the inclined plate 32 and then bends to the front side (the right side of FIG. 2) in a side view. The first transfer path 22 extends from the rear side (the left side of FIG. 2) to the front side of the multifunction device 10, and communicates with the sheet discharging tray 21 (see FIG. 1) through the image forming unit 24. That is, the sheet discharging tray 21 is arranged on the downstream side of the first transfer path 22 in the direction in which the recording sheet is conveyed. The recording sheet accommodated in the sheet feed tray 20 is guided so as to U-turn from a lower side to an upper side along the first transfer path 22, and reaches the image forming unit 24. Then, the image forming unit 24 forms images on the recording sheet, and discharges the recording sheet to the sheet discharging tray 21. In FIGS. 2 and 3, the sheet discharging tray 21 is not shown.

In the first transfer path 22, portions other than the portion in which the image forming unit 24 is provided are formed by a space between an outer guide surface and an inner guide surface. For example, a curved portion of the first transfer path 22 positioned at the rear side of the multifunction device 10 is formed by arranging an outer guide member 18 and an inner guide member 19 so as to be opposite to each other with a gap therebetween. The outer guide member 18 forms an outer curved guide surface, and the inner guide member 19 forms an inner curved guide surface. The outer guide member 18 and the inner guide member 19 are fixed to, for example, a case or a frame of the multifunction device 10.

<Recording Unit>

As shown in FIG. 3, the image forming unit 24 is provided on the first transfer path 22 that extends from the rear side to the front side of the multifunction device 10. The image forming unit 24 includes a carriage 40, an inkjet head 41, a CR motor 79 (see FIG. 6), and a platen 42. The inkjet head 41 is mounted to the carriage 40. The carriage 40 reciprocates along guide rails 43 and 44 in the width direction of the recording sheet (a direction vertical to the plane of FIG. 3). Although not shown in FIG. 3, a belt driving mechanism that is driven by a CR motor 79 is provided in the guide rail 44. The belt driving mechanism may be a known mechanism. For example, a driving pulley and a driven pulley are provided in the vicinities of both ends of the guide rail 44 in the width direction, and a seamless ring-shaped driving belt is wound around the driving pulley and the driven pulley. The carriage 40 is connected to the driving belt of the belt driving mechanism. In this way, when the CR motor 79 is driven, the driving force is transmitted to the carriage 40 through the belt driving mechanism, and the carriage 40 reciprocates.

The platen 42 is provided in the first transfer path 22 so as to be opposite to the inkjet head 41. The platen 42 supports the recording sheet conveyed along the first transfer path 22. The platen 42 supports the recording sheet with a head gap between the recording sheet and the inkjet head 41. Although not shown in the drawings, an ink cartridge is provided independently from the inkjet head 41 in the multifunction device 10. Various color inks are supplied from the ink cartridge to the inkjet head 41 through ink tubes. While the carriage 40 reciprocates, various color inks are selectively discharged as minute ink droplets from the inkjet head 41 to the platen 42. In this way, an image is recorded on the recording sheet that is conveyed on the platen 42.

Although not shown in FIG. 3, a linear encoder 83 (see FIG. 6) is provided in the carriage 40 and the guide rail 44. The linear encoder 83 detects the position of the carriage 40. The linear encoder 83 includes an encoder strip and an optical sensor that detects the pattern of the encoder strip. The encoder strip extends above the carriage 40 in the width direction of the guide rail 44 (in a direction vertical to the plane of FIG. 3). In the encoder strip, light transmitting portions that transmit light and light shielding portions that shield light are alternately arranged at a pitch in the longitudinal direction of the encoder strip, thereby creating a patter. An optical sensor is provided on the surface of the carriage 40 at a position corresponding to the encoder strip. The optical sensor reciprocates together with the carriage 40 to detect the pattern of the encoder strip. A control unit 70 (see FIG. 6), which will be described below, controls the reciprocation of the carriage 40 and the discharge of ink from the inkjet head 41 on the basis of the encoder amount output from the linear encoder 83. Although not shown in FIG. 3, a head control circuit 81 (see FIG. 6) that controls the discharge of ink from the inkjet head 41 is mounted on the carriage 40.

<Second Transfer Path>

As shown in FIG. 3, the second transfer path 23 connects the first transfer path 22 and the sheet feed tray 20. Specifically, one end of the second transfer path 23 is connected to a downstream-side portion 45 of the first transfer path 22 that is arranged on the downstream side of the image forming unit 24. The other end of the second transfer path 23 is connected to a portion of the sheet feed tray 20 that is arranged on the upstream side of the feed roller 25. The sheet feed tray 20 is connected to the first transfer path 22 through the inclined plate 32. Therefore, the second transfer path 23 is connected to an upstream-side portion 46 of the first transfer path 22 that is arranged on the upstream side of the image forming unit 24 through the feed roller 25. The second transfer path 23 guides the recording sheet that has an image formed on a rear surface (first surface) and that is switched back to the sheet feed tray 20.

The second transfer path 23 is defined by an upper guide member 47 and a lower guide member 48 that are opposite to each other with a gap therebetween. The upper guide member 47 and the lower guide member 48 extend in an oblique direction from the downstream-side portion 45 of the first transfer path 22 to the upstream side of the feed roller 25.

<Transfer Unit>

The transfer unit 15 conveys the recording sheets along the first transfer path 22 and the second transfer path 23. The transfer unit 15 includes the feed roller 25, a transfer roller 50, a discharge roller 51, a switch back roller 53, a frame 55, and an LF motor 77.

As shown in FIGS. 2 and 3, the transfer roller 50 is provided on the upstream side of the image forming unit 24 in the first transfer path 22. A plurality of pinch rollers are provided below the transfer roller 50 so as to come into pressure contact with the transfer roller 50. The transfer rollers 50 are provided in the width direction (in a direction vertical to the plane of FIG. 3) of the first transfer path 22, and the plurality of pinch rollers are arranged at intervals in the width direction of the first transfer path 22. The recording sheet that is conveyed along the first transfer path 22 is pinched between the transfer roller 50 and the pinch rollers, and then conveyed onto the platen 42.

The discharge roller 51 and a plurality of spurs 52 are provided on the downstream side of the image forming unit 24 in the first transfer path 22. The spurs 52 come into pressure contact with the discharge roller 51. The discharge roller 51 is provided in the width direction of the first transfer path 22. The plurality of spurs 52 are arranged at intervals in the width direction of the first transfer path 22. The recording sheet having an image formed thereon is pinched between the discharge roller 51 and the spurs 52, and then conveyed to the downstream-side portion 45 of the first transfer path 22.

The transfer roller 50 and the discharge roller 51 are driven by the LF motor 77, which serves as a driving source. The transfer roller 50 and the discharge roller 51 are driven in synchronization with each other. The transfer roller 50 and the discharge roller 51 are intermittently driven during image recording, and continuously driven before and after the image recording. In this way, the recording sheet is conveyed along the first transfer path 22 at a given speed until the recording sheet reaches the image forming unit 24, and when reaching the image forming unit 24, the recording sheet is intermittently conveyed by a line feed width. While the recording sheet is intermittently conveyed, the carriage 40 reciprocates, and the inkjet head 41 records an image at a position on the recording sheet.

Although not shown in FIGS. 2 and 3, a rotary encoder 82 (see FIG. 6) is provided on the transfer roller 50. The rotary encoder 82 includes an encoder disk that rotates together with the transfer roller 50 and an optical sensor that detects the pattern of the encoder disk. The control unit 70 (see FIG. 6) controls the rotation of the transfer roller 50 and the discharge roller 51 on the basis of the encoder amount output from the rotary encoder 82.

Although not shown in FIGS. 2 and 3, a range sensor 84 is provided on the upstream side of the transfer roller 50 in the first transfer path 22. The range sensor 84 includes a detector and an optical sensor. The detector is provided so as to be laid across the first transfer path 22. When the recording sheet comes into contact with the detector, the detector elastically retreats from the first transfer path 22. The motion of the detector is detected by the optical sensor. The control unit 70 determines whether the leading end or the trailing end of the recording sheet reaches the upstream side of the transfer roller 50 on the basis of a variation in the detection signal (hereinafter, referred to as a 'sensor signal') output from the detector.

As shown in FIG. 3, the switch back roller (SB roller) 53 and a plurality of spurs 54 are provided immediately below the downstream-side portion 45 of the first transfer path 22. The spurs 54 come into pressure contact with the switch back roller 53. The switch back roller 53 is provided in the width direction of the first transfer path 22. The plurality of spurs 54 are arranged at intervals in the width direction of the first transfer path 22. The recording sheet having an image formed on the front surface is pinched between the switch back roller 53 and the spurs 54, and then switched back and conveyed. In addition, the recording sheet having images formed on both surfaces is pinched and discharged to the sheet discharging tray 21.

The switch back roller 53 is driven by the LF motor 77, which serves as a driving source. The switch back roller 53 can be rotated forward and backward. The forward or backward rotation direction of the switch back roller 53 is controlled by the driving of the LF motor 77. During a process of transmitting the driving force of the LF motor 77 to the switch back roller 53, the rotation of the LF motor 77 may be transmitted as the forward and backward rotations of the switching back roller 53 by a gear shift.

The 'forward' or 'backward' rotation of the switch back roller 53 is a relative motion. However, in this exemplary embodiment, the rotation of the switch back roller 53 to convey the recording sheet to the sheet discharging tray 21 is referred to as a 'forward rotation', and the rotation thereof to convey the recording sheet to the second transfer path 23 is referred to as a 'backward rotation'.

The spurs 54 are supported by the frame 55, and slide so as to come into contract with or be separated from the switch back roller 53. Although not shown in detail in FIGS. 2 and 3, the rotating shaft of the spurs 54 is elastically urged by a coil spring to come into pressure contact with the switch back roller 53. Therefore, when the switch back roller 53 is rotated, the spurs 54 are also rotated with the rotation of the switch back roller 53. The elastic urging force applied to the spurs 54 by the coil spring acts as a force to nip the recording sheet, which is generated by the switch back roller 53 and the spurs 54. Since the switch back roller 53 and the spurs 54 pinch the recording sheet immediately after image recording, the nipping force generated by the switch back roller 53 and the spurs 54 is relatively weak. Therefore, when an external force is applied to the recording sheet which is pinched between the switch back roller 53 and the spurs 54, the rigidity (strength) of the recording sheet overcomes the nipping force, and the posture of the recording sheet is easily changed. That is, when an external force is applied to the recording sheet, the recording sheet is likely to slip between the switch back roller 53 and the spurs 54.

<Path Switching Unit>

Figure 4:
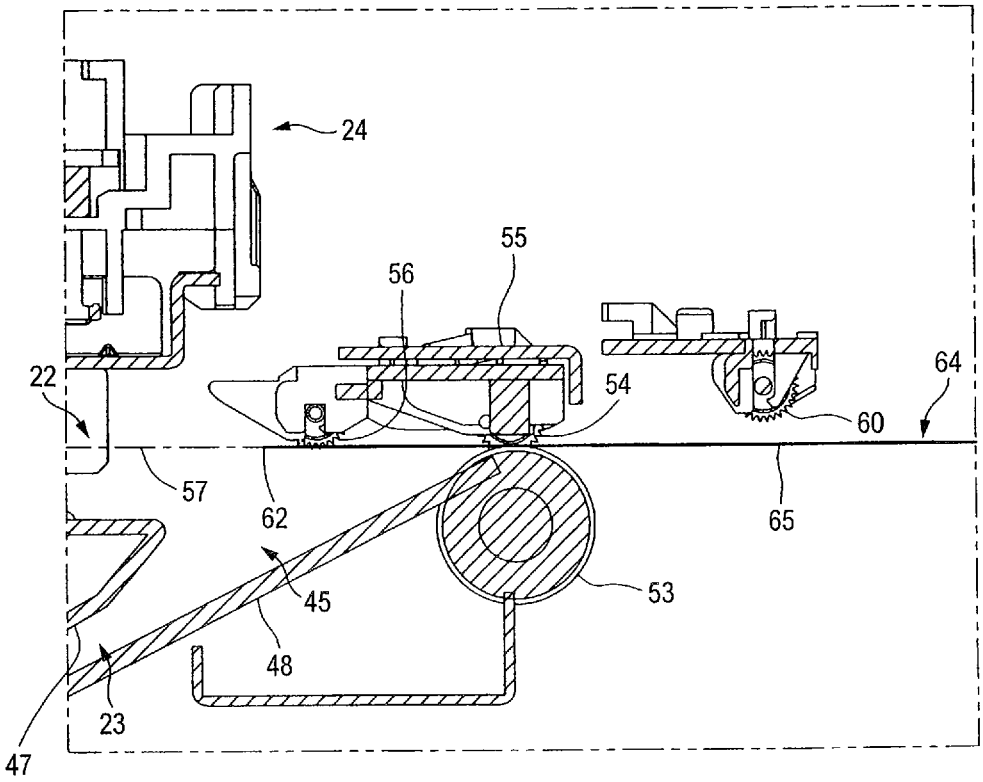
FIG. 4 is an enlarged cross-sectional view illustrating a frame of the multifunction device of FIG. 1 in a first posture.
Figure 5:
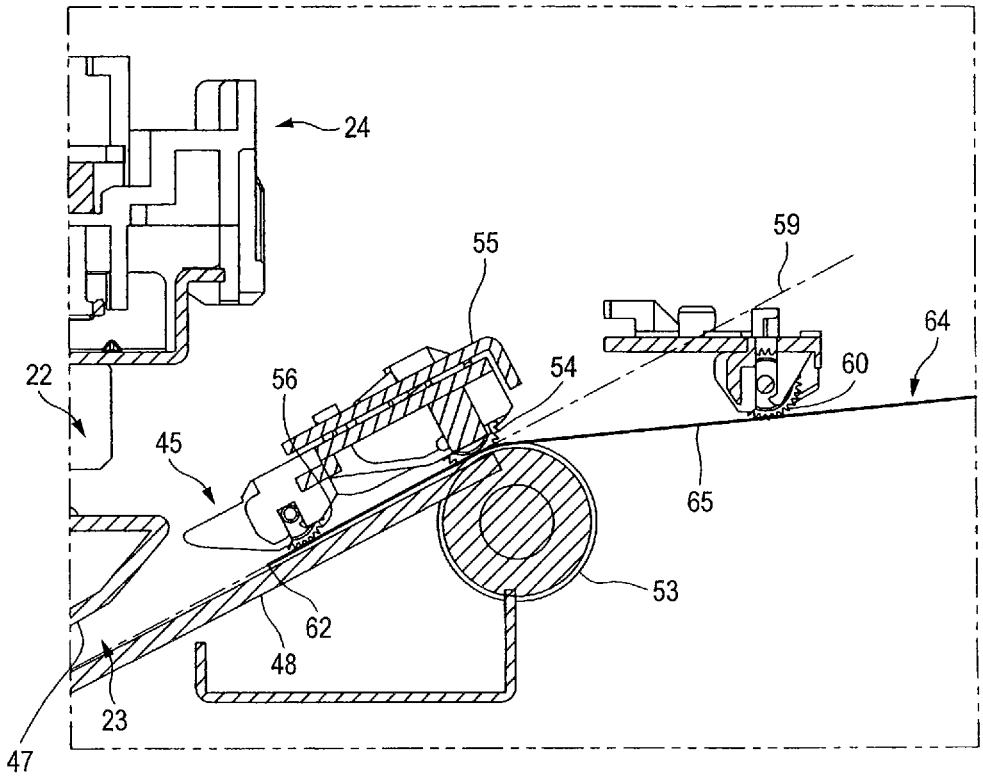
FIG. 5 is an enlarged cross-sectional view illustrating the frame of the multifunction device of FIG. 1 in a second posture.

Next, the path switching unit will be described. FIG. 4 is an enlarged cross-sectional view illustrating the frame 55 in a first posture. FIG. 5 is an enlarged cross-sectional view illustrating the frame 55 in a second posture.

The path switching unit includes the frame 55 and a plurality of spurs 56. The switch back roller 53 is rotatably supported by the frame 55. The frame 55 extends from the switch back roller 53 to the upstream side of the conveyance direction (to the left side in FIGS. 4 and 5), and reaches the downstream-side portion 45. The spurs 56 are rotatably supported by the end of the extending portion of the frame 55, and the spurs 56 are arranged in the downstream-side portion 45. The frame 55 extends in the width direction of the first transfer path 22, and the plurality of spurs 56 are arranged at intervals in the width direction of the first transfer path 22.

The frame 55 is configured such that the end of the extending portion thereof (i.e., the left side in FIGS. 4 and 5) can rotate on the rotating shaft of the switch back roller 53. The frame 55 is driven by the driving force of the LF motor 77 to change posture to a rotation position. The rotation position includes the first and second postures, which will be described below. The spurs 54 supported by the base of the frame 55 and the spurs 56 supported by the end of the extending portion of the frame 55 rotate on the rotating shaft of the switch back roller 53 together with the frame 55.

As shown in FIG. 4, the extending portion of the frame 55 extends from the switch back roller 53 in the horizontal direction when the frame 55 is in the first posture. In the first posture, a tangent line 57 of the spur 56 passing through the nipping position between the switch back roller 53 and the spur 54 is aligned with a line linking the nipping position between the transfer roller 50 and the pinch roller to the nipping position between the discharge roller 51 and the spurs 52. That is, a recording sheet 65 that is pinched between the transfer roller 50 and the pinch roller and between the discharge roller 51 and the spurs 52 is conveyed along the tangent line 57. The recording sheet 65 conveyed along the tangent line 57 passes through the lowest portions of the spurs 56 and is then pinched between the switch back roller 53 and the spurs 54. That is, the recording sheet 65 is guided to the sheet discharging tray 21 by the frame 55 in the first posture.

As shown in FIG. 5, in the second posture, the extending portion of the frame 55 extends downward from the switch back roller 53 in an oblique direction. When the frame 55 changes posture from the first posture to the second posture, the spurs 54 and 56 rotate on the rotating shaft of the switch back roller 53 together with the frame 55. The tailing end 62 of the recording sheet 65 that is switched back and conveyed by the switch back roller 53 and the spurs 54 is guided in the direction of the tangent line 59 by the spurs 56. The tangent line 59 is of the spur 56 that passes through the nipping position between the switch back roller 53 and the spurs 54. The frame 55 in the second posture guides the recording sheet 65 in the direction in which the recording sheet 65 can pass through the second transfer path 23.

As shown in FIGS. 4 and 5, a plurality of spurs 60 are provided on the downstream side of the switch back roller 53 and the spurs 54 in the conveyance direction. The plurality of spurs 60 are provided at intervals in the width direction of the first transfer path 22. The spurs 60 are arranged such that their lowest portions are positioned above the lowest portions of the spurs 54. Therefore, as shown in FIG. 4, the recording sheet 65 that is conveyed along the tangent line 57 by the frame 55 in the first posture does not contact the spurs 60.

When the recording sheet 65 that is switched back and conveyed along the tangent line 59 by the frame 55 in the second posture passes through the pinching position between the switch back roller 53 and the spurs 54, a portion thereof facing the sheet discharging tray 21 is raised along the tangent line 59 due to the rigidity of the recording sheet 65. In this case, as shown in FIG. 5, the spurs 60 contact a portion of the recording sheet 65. The recording sheet 65 is bent by contact with the spurs 60 and then wound around the switch back roller 53. In this way, the rigidity of the recording sheet 65 acts as a pressing force against the switch back roller 53.

<Control Unit>

Figure 6:
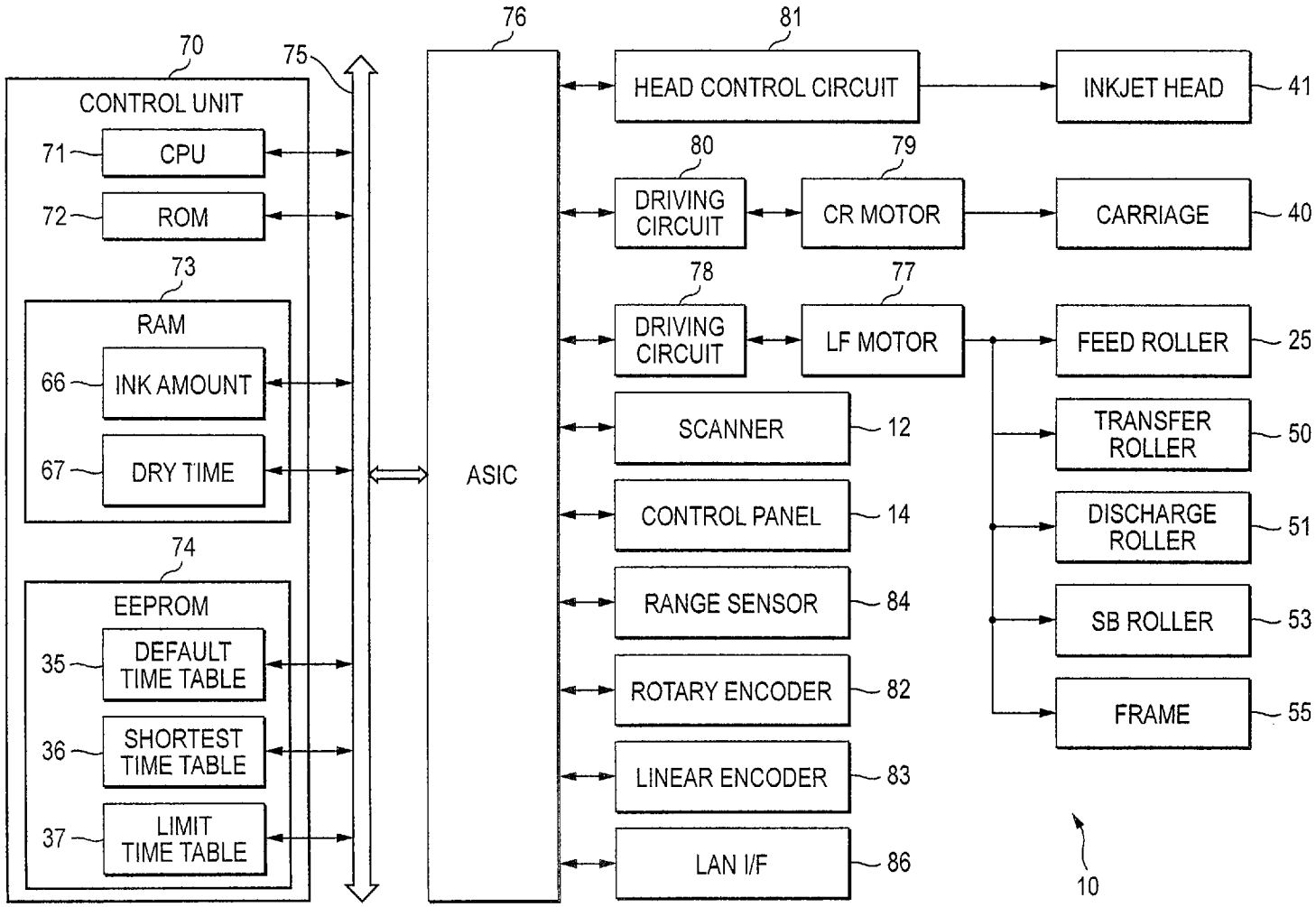
FIG. 6 is a block diagram illustrating an example of a structure of a control unit of the multifunction device of FIG. 1.

FIG. 6 is a block diagram illustrating an example of a configuration of the control unit 70 of the multifunction device 10.

The control unit 70 controls the overall operation of the multifunction machine 10 including the printer 11 and the scanner 12. The control unit 70 is formed of a main board, and is arranged at a predetermined position of the multifunction device 10. A detailed description of the structure of controlling the scanner 12 will be omitted.

The control unit 70 comprises a microcomputer having, as main components, a central processing unit (CPU) 71, a read only memory (ROM) 72, a random access memory (RAM) 73, and an electrically erasable and programmable ROM (EEPROM) 74. The control unit 70 is coupled to an application specific integrated circuit (ASIC) 76 through a bus 75.

The ROM 72 stores programs for the CPU 71 to control various operations of the multifunction device 10. The RAM 73 is used as a storage area or a working area that temporarily stores various data used by the CPU 71 to execute the programs. The RAM 73 stores, for example, print data, an ink amount 66, and a dry time 67. The print data is generated on the basis of image data of the document scanned by the scanner 12. The printer 11 performs double-sided image forming on the basis of the print data. However, the print data is not limited thereto. That is, the print data may be acquired from a computer (PC) that is connected to the multifunction device through, for example, a LAN so as to communicate therewith. The ink amount 66 and the dry time 67 will be described below.

The EEPROM 74 stores setup conditions or flags that should be stored after power is turned off. In this exemplary embodiment, the EEPROM 74 stores a default time table 35, a shortest time table 36, and a limit time table 37, which will be described in detail below. The control unit 70 including the CPU 71, the ROM 72, the RAM 73, and the EEPROM 74 functions as a portion of a detecting unit, a setting unit, a control unit, an acquiring unit, and a dividing unit.

The ASIC 76 is coupled to a head control circuit 81, a driving circuit 80, a driving circuit 78, the scanner 12, the control panel 14, the range sensor 84, the rotary encoder 82, the linear encoder 83, and a local area network interface (LAN I/F) 86.

The ASIC 76 generates a phase excitation signal for turning on the LF motor 77 in response to instructions from the CPU 71. The signal is transmitted to the driving circuit 78 of the LF motor 77, and the driving circuit 78 turns on the LF motor 77 in response to the driving signal. In this way, the rotation of the LF motor 77 is controlled.

The driving circuit 78 drives the LF motor 77. The LF motor 77 is coupled to the feed roller 25, the transfer roller 50, the discharge roller 51, the switch back roller (SB roller) 53, and the frame 55. The driving circuit 78 receives the signal output from the ASIC 76, and generates an electric signal for driving the LF motor 77. The LF motor 77 is driven in response to the electric signal. The rotating force of the LF motor 77 is transmitted to the feed roller 25, the transfer roller 50, the discharge roller 51, the switch back roller 53, and the frame 55. In addition, the rotating force of the LF motor 77 is transmitted to, for example, the switch back roller 53 and the frame 55 through a known driving mechanism, such as a gear or a driving shaft. The control unit 70 controls the rotation of the LF motor 77 and the operation of the driving mechanism to control the forward or backward rotation of the switch back roller 53 and the posture of the frame 55.

The ASIC 76 generates, for example, a phase excitation signal for turning on the CR motor 79 in response to instructions from the CPU 71. The signal is transmitted to the driving circuit 80 of the CR motor 79, and the driving circuit 80 turns on the CR motor 79 in response to the driving signal. In this way, the rotation of the CR motor 79 is controlled.

The driving circuit 80 drives the CR motor 79. The driving circuit 80 receives the signal output from the ASIC 76, and generates an electric signal for driving the CR motor 77. The CR motor 79 is driven in response to the electric signal. The rotating force of the CR motor 79 is transmitted to the carriage 40 through a predetermined driving mechanism to reciprocate the carriage 40. In this way, the reciprocation of the carriage 40 is controlled by the control unit 70.

The head control circuit 81 controls the operation of the inkjet head 41 on the basis of print data received from the ASIC 76. In this way, the inkjet head 41 selectively discharges various color inks at a predetermining timing to record images on a recording sheet. The head control circuit 81 and the inkjet head 41 are mounted to the carriage 40.

The rotary encoder 82 detects the rotation angle of the transfer roller 50. The linear encoder 83 detects the position of the carriage 40. The range sensor 84 detects the leading end and the trailing end of the recording sheet. The control unit 70 checks the displacement of the carriage 40 on the basis of the encoder amount detected by the linear encoder 83. The control unit 70 controls the rotation of the CR motor 79 in order to control the reciprocation of the carriage 40 on the basis of the displacement. In addition, the control unit 70 checks the position of the leading end or the trailing end of the recording sheet 74 on the basis of the output signal from the range sensor 84 and the encoder amount output from the rotary encoder 82.

<Jam Detection>

In the double-sided image forming mode, when the arm 55 is maintained in the second posture (see FIG. 5), the switch back roller 53 rotates in the backward direction to convey the recording sheet 65 with the trailing end 62 facing the second transfer path 23. The trailing end 62 of the recording sheet 65 conveyed to the second transfer path 23 passes through a nipping point between the recording sheet on the sheet feed tray 20 and the feed roller 25. Then, the feed roller 25 is rotated to convey the recording sheet 65 to the first transfer path 22. The range sensor 84 is provided in the first transfer path 22. The control unit 70 detects a jam of the recording sheet 65 on the basis of the sensor signal output from the range sensor 84, while controlling the driving of the LF motor 77 to switch back and convey the recording sheet 65. The control unit 70 conveys the recording sheet 65 by a predetermined distance, and when the range sensor 84 detects the recording sheet 65, the control unit determines that the recording sheet 65 is not jammed. The control unit 70 determines that the recording sheet 65 is jammed when the range sensor 84 does not detect the recording sheet 65 even though the recording sheet 65 is conveyed by the predetermined distance.

The scanner 12 scans image data of a document. The printer 11 performs image recoding on the basis of print data that is generated by the control unit 70 on the basis of the image data. The control panel 14 allows information to be input to the multifunction device 10. The multifunction device 10 operates on the basis of the information that is input to the control panel 14. For example, the control panel 14 may be operated to select a single-sided recording mode or a double-sided image forming mode. In the single-sided recording mode, images are recorded on only one surface 64 of the recording sheet 65. In the double-sided image forming mode, images are recorded on the front and rear surfaces of the recording sheet 65.

The LAN I/F 86 couples a local area network (LAN) (not shown) and the multifunction device 10 such that they can communicate with each other. Although not shown in the drawings, the multifunction device 10 is coupled to a computer (for example, a PC) through the LAN I/F 86 and the LAN so as to communicate with the computer. The printer 11 may perform double-sided printing on the basis of print data transmitted from the computer.

Further, although not shown in the drawings, the ASIC 76 is coupled to the slot unit 16 and a network control unit (NCU) or a modem for implementing the function of a facsimile, in addition to the scanner 12 and the control panel 14.

When the printer 11 performs double-sided image forming, the transfer unit 15 sequentially performs a first conveying operation and a second conveying operation. The first conveying operation conveys the recording sheet with the front surface thereof facing the inkjet head 41 of the image forming unit 24. The second conveying operation conveys the recording sheet subjected to the first conveying operation with the rear surface thereof facing the inkjet head 41 of the image forming unit 24.

<First Conveying Operation>

The feed roller 25 comes into pressure contact with the uppermost one of the recording sheets loaded on the sheet feed tray 20. For example, when the control panel 14 is operated to select the double-sided image forming mode, the transfer unit starts the first conveying operation. In the first conveying operation, first, the LF motor 77 is driven to transmit a driving force to the feed roller 25. The feed roller 25 is rotated by the driving force to feed the uppermost one of the recording sheets on the sheet feed tray 20 to the first transfer path 22 in the direction of an arrow 17 (see FIG. 3). The recording sheet fed to the first transfer path 22 is conveyed along the first transfer path 22 by the transfer roller 50, the pinch roller, the discharge roller 51 and the spurs 52, with the front surface thereof facing the inkjet head 41. While the recording sheet is conveyed, the inkjet head 41 discharges ink onto the recording sheet to record an image on the front surface of the recording sheet.

The recording sheet 65 (see FIG. 4) is conveyed from the image forming unit 24 to the path switching unit that is provided in the downstream-side portion 45. When the path switching unit receives the driving force transmitted from the LF motor 77, the arm 55 is maintained in the first posture and the switch back roller 53 is rotated in the forward direction. Therefore, the recording sheet 65 having an image recorded on one surface (e.g., a front surface 64) is conveyed to the sheet discharging tray 21. When the trailing end 62 of the recording sheet 65 reaches a certain position (see FIG. 4) that is at the upstream side of the spurs 56, the transfer roller 50, the discharge roller 51, and the switch back roller 53 stop. Then, the recording sheet 65 stops, and the first conveying operation is completed. The position where the recording sheet 65 stops is not limited to the position shown in FIG. 4. For example, the position may be a position where the trailing end 62 of the recording sheet 65 is disposed at the upstream side of the spurs 52 (see FIG. 3). Alternatively, the position may be a position where the recording sheet 65 is switched back and conveyed to the second transfer path 23 such that the trailing end 62 thereof does not reach the feed roller 15.

<Second Conveying Operation>

After a dry time 67 (see FIG. 6), which will be described below, has elapsed after the first conveying operation has been completed, the transfer unit 15 starts the second conveying operation. In the second conveying operation, first, the driving force of the LF motor 77 is transmitted to the arm 55 of the path switching unit to change the posture of the arm 55 from the first posture (see FIG. 4) to the second posture (see FIG. 5). The trailing end 62 of the recording sheet 65 is pressed downward by the spurs 56 to face the second transfer path 23. Then, the switch back roller 53 is rotated in the backward direction, and the conveyance direction of the recording sheet 65 is changed. The recording sheet 65 is switched back and conveyed along the second transfer path 23. The recording sheet 65 is conveyed to a position (hereinafter, referred to as a 'contact position') between the uppermost recording sheet on the sheet feed tray 20 and the feed roller 25.

When the feed roller 25 is rotated, the recording sheet 65 is fed from the second transfer path 23 to the upstream side (the upstream-side portion 46) of the image forming unit 24 in the first transfer path 22 (see FIG. 3). As a result, the recording sheet 65 is reversed and conveyed to the first transfer path 22. The recording sheet 65 is conveyed again along the first transfer path 22 by the transfer roller 50, the pinch roller, the discharge roller 51, and the spurs 52, with the rear surface thereof facing the inkjet head 41 of the image forming unit 24. The rear surface of the recording sheet 65 is an opposite surface of the front surface 64. While the recording sheet 65 is conveyed, the inkjet head 41 discharges ink onto the recording sheet 65 to record an image on the rear surface of the recording sheet 65. When the path switching unit is operated by the driving force from the LF motor 77, the posture of the arm 55 is changed from the second posture to the first posture, and the switching back roller 53 is rotated in the forward direction. Therefore, the recording sheet 65 having the image formed on the rear surface is discharged from the first transfer path 22 to the sheet discharging tray 21. In this way, the second conveying operation is completed.

<Dry Time>

As described above, when images are formed on both surfaces of the recording sheet 65, the control unit 70 sets a dry time 67 until the first conveying operation is completed. That is, the control unit 70 determines the dry time 67 and stores the determined dry time in the RAM 73. The dry time 67 is a time that it takes to dry ink that is discharged onto the front surface 64 of the recording sheet 65 by the image forming unit 24 while the recording sheet 65 is subjected to the first conveying operation. The dry time 67 is set whenever double-sided image forming is performed. Therefore, the dry time 67 stored in the RAM 73 is updated whenever the double-sided image forming is performed.

The control unit 70 controls the transfer unit 15 to start the second conveying operation after the dry time 67 has elapsed after the first conveying operation has been completed. That is, the recording sheet 65 stands by at a certain position until the dry time 67 elapses after the first conveying operation has been completed. In this exemplary embodiment, as shown in FIG. 4, the recording sheet 65 stops for the dry time 67 with the trailing end 62 thereof located at the upstream side of the spurs 56.

As described above, after the dry time 67 has elapsed from the first conveying operation, the second conveying operation starts. The recording sheet 65 is switched back and conveyed along the second transfer path 23 with the trailing end 62 of the recording sheet 65 facing the second transfer path.

When the dry time 67 is set to a long time, the recording sheet 65 is switched back and conveyed with the ink recorded on the front surface 64 of the recording sheet 65 being sufficiently dried. In this case, it is considered that the trailing end 62 of the recording sheet 65 is correctly conveyed to the contact position and the recording sheet 65 is fed to the first transfer path 22 without a paper jam.

On the other hand, when the dry time 67 is very short, the recording sheet 65 is switched back and conveyed without the ink recorded on the front surface 64 of the recording sheet 65 being sufficiently dried. That is, the recording sheet 65 is switched back and conveyed with the surface thereof being wetted by ink droplets. Since the recording sheet 65 is still wet, the recording sheet 65 is less rigid than a recording sheet that is sufficiently dry. In this case, the recording sheet 65 becomes caught in the second transfer path 23 or the trailing end 62 is not correctly conveyed to the contact position, which causes a jam of the recording sheet 65. As described above, in the multifunction device 10 according to this exemplary embodiment, it is assumed that a jam occurs in the second transfer path 23. The dry time 67 is set sufficiently long for the ink recorded on the recording sheet 65 not to cause a paper jam. In this exemplary embodiment, the dry time 67 is set to an appropriate value with reference to the occurrence conditions of the jam of the recording sheet 65 and the ink amount 66.

<Ink Amount>

The ink amount 66 is data indicating an amount of ink discharged from the image forming unit 24 onto the front surface 64 of the recording sheet 65 when the printer 11 performs double-sided image forming. The control unit 70 acquires the amount of ink discharged from the inkjet head 41 of the image forming unit 24 onto the front surface 64 of the recording sheet 65 on the basis of, for example, print data. In this exemplary embodiment, the dry time 67 is determined on the basis of the ink amount 66. Alternatively, the ink amount may be acquired by measuring the actual amount of ink discharged from the inkjet head 41.

Figure 7:
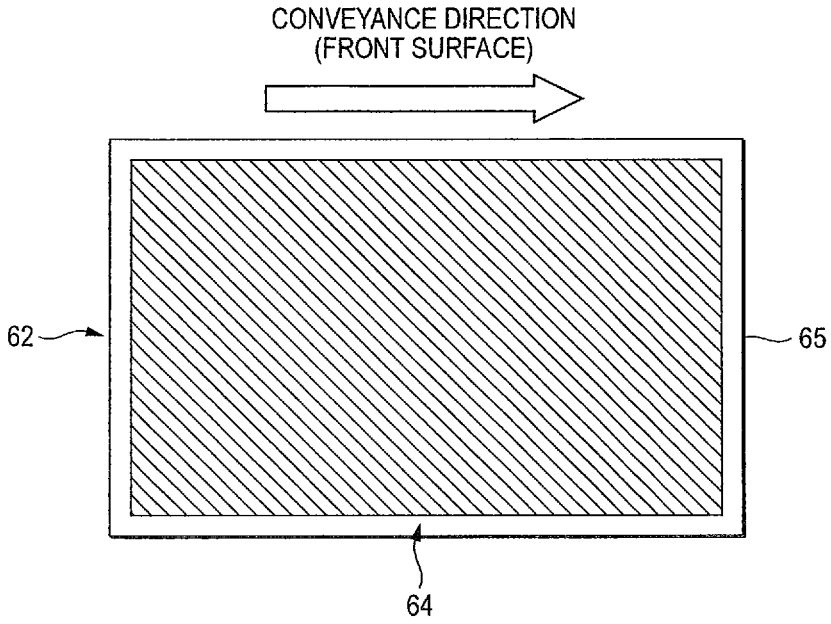
FIG. 7 is a diagram schematically illustrating a front surface of a recording sheet.

FIG. 7 is a diagram schematically illustrating a front surface 64 of the recording sheet 65. In FIG. 7, an arrow indicates the direction in which the recording sheet 65 is conveyed during the first conveying operation.

When the printer 11 performs a double-sided image forming process, for example, the scanner 12 scans the image of a document, and print data is stored in the RAM 73. The control unit 70 calculates the amount of ink discharged from the inkjet head 41 on the basis of the print data, and stores the calculated result as the ink amount 66 in the RAM 73. As shown in FIG. 7, in this example, the recording sheet 65 is completely covered in ink, and accordingly, the control unit 70 calculates the amount of ink adhered to the entire recording surface in the front surface 64 of the recording sheet 65 from the print data. Then, the control unit 70 stores the calculated amount of ink as the ink amount 66 in the RAM 73. Similarly, if only a part of the front surface of the recording sheet is covered in ink, the control unit 70 calculates the amount of ink adhered to the part of the recording surface and stores this calculated amount of ink as the ink amount 66 in the RAM 73. Since a method of calculating the amount of ink discharged from the inkjet head 41 from the print data is known, a detailed description thereof will be omitted.

FIGS. 8A to 8C are diagrams illustrating tables stored in the EEPROM 74. Specifically, FIG. 8A shows a default time table 35, FIG. 8B shows a shortest time table 36, and FIG. 8C shows a limit time table 37.

As shown in FIG. 8A, the default time table 35 has two fields, that is, an 'ink amount' field and a 'default time' field. The amount of ink discharged from the inkjet head 41 to the front surface 64 of the recording sheet 65 is stored in the 'ink amount' field beforehand. FIG. 8A shows the ink amount, when the total amount of ink discharged onto the entire front surface 64 of the recording sheet 65 is '100'. For example, a range "0 to 10" in the "ink amount" field denotes that the amount of ink discharged from the inkjet head 41 to the front surface 64 of the recording sheet 65 is in a range of about 0% to about 10% of the total amount of ink which a recording sheet may accommodate. For example, a range '80 to 90' in the 'ink amount' field denotes that the amount of ink discharged from the inkjet head 41 to the front surface 64 of the recording sheet 65 is in a range of about 80% to about 90% of the total amount of ink which a recording sheet may accommodate. A default dry time (hereinafter, referred to as a 'default time') is stored in the 'default time' field. In the EEPROM 74, information in each field is stored in the same record of the time table 35 such that the information is associated with each other.

For example, when the printer 11 has performed no double-sided image forming process, such as immediately after the multifunction device 10 is turned on, the default time table 35 is referenced. That is, when no dry time 67 is stored in the RAM 73, the control unit 70 reads the default time from the default time table 35 and sets the read default time as the dry time 67. For example, the control unit 70 acquires an ink amount '15' that is to be discharged from the inkjet head 41 to the front surface 64 of the recording sheet 65 on the basis of the print data. In this case, the control unit 70 reads, from the default time table 35, a default time T1 written in the 'default time' field in the record in which a range '10 to 20' is stored in the 'ink amount' field, and sets the read default time as the dry time 67. In addition, for example, the control unit 70 acquires an ink amount '85' that is discharged from the inkjet head 41 to the front surface 64 of the recording sheet 65 on the basis of the print data. In this case, the control unit 70 reads, from the default time table 35, a default time T9 written in the 'default time' field in the record in which a range '80 to 90' is stored in the 'ink amount' field, and sets the read default time as the dry time 67.

As shown in FIG. 8B, the shortest time table 36 has two fields, that is, an 'ink amount' field and a 'shortest time' field. Similar to the 'ink amount' field of the default time table 35, the amount of ink discharged from the inkjet head 41 to the front surface 64 of the recording sheet 65 is stored in the 'ink amount' field beforehand. The shortest dry time (hereinafter, referred to as the 'shortest time') when the control unit 70 detects no jam is stored in the 'shortest time' field. In the EEPROM 74, information in each field is stored in the same record of the shortest time table 36 such that the information is associated with each other.

For example, the control unit 70 sets the dry time 67 for a double-sided image forming process of discharging an ink amount '23' onto the front surface 64. Then, in the double-sided image forming process, when the range sensor 84 detects no jam, the control unit 70 stores the dry time 67 as the shortest time TC in the 'shortest time' field in the record in which a range '20 to 30' is stored in the 'ink amount' field. In addition, for example, the control unit 70 sets the dry time 67 for a double-sided image forming process of discharging an ink amount '95' onto the front surface 64. Then, in the double-sided image forming process, when the range sensor 84 detects no jam, the control unit 70 stores the dry time 67 as the shortest time TK in the 'shortest time' field in the record in which a range '90 to 100' is stored in the 'ink amount' field. As such, in the shortest time table 36, among the dry times 67 that are set for the double-sided image forming processes in which no jam is detected, the shortest dry time 67 (shortest time) is stored for each ink amount. The shortest time is the shortest dry time among the dry times 67 set for the previous double-sided image forming processes without a paper jam.

As shown in FIG. 8C, the limit time table 37 has two fields, that is, an 'ink amount' field and a 'limit time' field. Similar to the 'ink amount' field of the default time table 35, the amount of ink discharged from the inkjet head 41 to the front surface 64 of the recording sheet 65 is stored in the 'ink amount' field beforehand. As will be described in detail below, when no jam is detected in the previous double-sided image forming process, the dry time 67 is set to be shorter than that in the previous double-sided image forming process. When the control unit 70 determines that a jam occurs on the basis of a sensor signal output from the range sensor 84, it is considered that the shortest time stored in the shortest time table 36 is the shortest dry time (hereinafter, referred to as a 'limit time') when it is detected that no jam occurs. When it is detected that a jam occurs, the shortest time stored in the shortest time table 36 is stored as the limit time in the 'limit time' field. In the EEPROM 74, information in each field is stored in the same record of the limit time table 37 such that the information is associated with each other.

For example, the control unit 70 detects that no jam occurs in the double-sided image forming process in which a time K1 is set as the dry time 67 and an ink amount is '15'. In this case, the control unit 70 stores the time K1 in the 'shortest time' field in the record in which the range '10-20' is stored in the 'ink amount' field of the shortest time table 36. Then, the control unit 70 detects that a jam occurs in the next double-sided image forming process in which a time K2 is set as the dry time 67 and an ink amount is '15'. In this case, the control unit 70 reads the shortest time TB, which is the time K1, from the 'shortest time' field in the record in which a range '10 to 20' is stored in the 'ink amount' field, with reference to the shortest time table 36. Then, the control unit 70 stores the read shortest time TB as a limit time TIII in the 'limit time' field in the record in which the range '10 to 20' is stored in the 'ink amount' field of the limit time table 37.

In this exemplary embodiment, the ink amount is divided into 10 levels in the tables 35 to 37, but the number of records in the 'ink amount' field may less than or greater than 10.

As described above, if the control unit 70 detects that a jam occurs, the EEPROM 74 stores, as the limit time, the shortest dry time 67 (the shortest time stored in the shortest time table 36) when the control unit 70 detects that no jam occurs in the previous double-sided image forming process. The limit time is stored in the EEPROM 74 so as to be associated with the ink amount on the front surface 64 that is acquired from the print data by the control unit 70.

In a series of several double-sided image forming processes, the setting of the dry time 67 is changed as follows with reference to the default time table 35, the shortest time table 36, and the limit time table 37.

FIG. 9 is a diagram illustrating an example of changing the setting of the dry time 67. FIG. 9 shows the dry times 67 for seven recording sheets 65 when the dry time 67 corresponding to an initial (first) double-sided image forming process of the multifunction device 10, such as a double-sided image forming process immediately after the multifunction device 10 is turned on, is '100'.

For example, when the multifunction device 10 performs a first double-sided image forming process (i.e., a double-sided image forming process for a first recording sheet 65), such as immediately after the multifunction device 10 is turned on, the control unit 70 acquires an ink amount '55' on the basis of print data recorded on the front surface 64 of the first recording sheet 65. Since no double-sided image forming process has been performed, the control unit 70 reads a dry time '100' corresponding to the ink amount '55' with reference to the default time table 35 (see FIG. 8A), and sets the read dry time as the dry time 67. The control unit 70 detects whether a jam occurs in the second conveyance operation during the current double-sided image forming process. If no jam occurs, the control unit 70 stores information indicating that no jam occurs in the RAM 73.

When performing the double-sided image forming process on the second recording sheet 65, the control unit 70 acquires an ink amount '55' on the basis of print data recorded on the front surface 64 of the second recording sheet. In the double-sided image forming process on the second recording sheet 65, the ink amount '55' discharged from the inkjet head 41 to the front surface 64 is equal to that discharged to the front surface 64 of the first recording sheet 65. In the double-sided image forming process on the first recording sheet 65, no jam was detected. In this case, the control unit 70 sets the dry time 67 in the double-sided image forming process on the second recording sheet 65 to '95' that is shorter than the dry time '100' in the previous double-sided image forming process on the first recording sheet 65.

When performing the double-sided image forming process on the third recording sheet 65, the control unit 70 acquires an ink amount '55' on the basis of print data recorded on the front surface 64 of the third recording sheet. The ink amount is equal to that discharged to the front surface 64 of the second recording sheet 65. In the double-sided image forming process on the second recording sheet 65, 'no jam' has been detected. In this case, the control unit 70 sets the dry time 67 in the double-sided image forming process on the third recording sheet 65 to '90' that is shorter than the dry time '95' in the previous double-sided image forming process on the second recording sheet 65. As such, if no jam is detected in the previous double-sided image forming process, the control unit 70 sets the dry time 67 in the current double-sided image forming process to be shorter than the dry time 67 in the previous double-sided image forming process.

Since it is determined that a jam occurs in the double-sided image forming process on the third recording sheet 65, the control unit 70 stores the dry time '95' as the limit time in the limit time table 37 (see FIG. 8C). That is, if it has been detected that a jam occurs, the control unit 70 stores the shortest dry time '95' of the dry times '100' and '95' when no jam is detected in the previous double-sided image forming processes as the limit time in the EEPROM 74.

When performing the double-sided image forming process on the fourth recording sheet 65, the control unit 70 acquires an ink amount '55' on the basis of print data recorded on the front surface 64 of the fourth recording sheet. As described above, the limit time '95' corresponding to the ink amount '55' is stored in the limit time table 37. The control unit 70 reads the limit time '95' corresponding to the ink amount '55' from the limit time table 37, and sets the read time to the dry time 67 in the double-sided image forming process on the fourth recording sheet 65. As such, the control unit 70 sets the dry time 67 in the double-sided image forming process that is performed with substantially the same ink amount as that in the previous double-sided image forming process in which a jam has occurred as the limit time that is stored in the limit time table 37. The limit time '95' stored in the limit time table 37 is longer than the dry time '90' in the double-sided image forming process on the third recording sheet 65 in which a jam is detected. Therefore, the dry time 67 in the double-sided image forming process on the fourth recording sheet 65 is set to be longer than the dry time 67 in the previous double-sided image forming process if it has been detected that a jam occurs in the previous double-sided image forming process.

When performing the double-sided image forming process on the fifth recording sheet 65, the control unit 70 acquires an ink amount '45' on the basis of print data recorded on the front surface 64 of the fifth recording sheet. This ink amount is smaller than the ink amount '55' discharged to the front surface 64 of the fourth recording sheet 65 in the previous double-sided image forming process. In the double-sided image forming process on the fourth recording sheet, 'no jam' has been detected. In this case, the control unit 70 sets the dry time 67 in the double-sided image forming process on the fifth recording sheet 65 to '85' that is shorter than the dry time '95' in the previous double-sided image forming process on the fourth recording sheet 65. As such, if the ink amount acquired by the current double-sided image forming process is smaller than the ink amount 66 acquired by the previous double-sided image forming process, the control unit 70 sets the dry time 67 in the current double-sided image forming process to be shorter than the dry time 67 in the previous double-sided image forming process.

When performing the double-sided image forming process on the sixth recording sheet 65, the control unit 70 acquires an ink amount '75' on the basis of print data recorded on the front surface 64 of the sixth recording sheet. This ink amount is larger than the ink amount '45' discharged onto the front surface 64 of the fifth recording sheet 65 in the previous double-sided image forming process. In the double-sided image forming process on the fifth recording sheet, 'no jam' has been detected. In this case, the control unit 70 sets the dry time 67 in the double-sided image forming process on the sixth recording sheet 65 to '110' that is longer than the dry time '85' in the previous double-sided image forming process on the fifth recording sheet 65. As such, if the ink amount acquired by the current double-sided image forming process is larger than the ink amount 66 acquired by the previous double-sided image forming process, the control unit 70 sets the dry time 67 in the current double-sided image forming process to be longer than the dry time 67 in the previous double-sided image forming process.

When performing the double-sided image forming process on the seventh recording sheet 65, the control unit 70 acquires an ink amount '55' on the basis of print data recorded on the front surface 64 of the seventh recording sheet. As described above, a limit time corresponding to the ink amount '55' is stored in the limit time table 37. Therefore, the control unit 70 reads the limit time '95' corresponding to the ink amount '55' that is acquired in the double-sided image forming process on the seventh recording sheet 65 from the limit time table 37, and sets the read time as the dry time 67. As such, after it is detected that the recording sheet 65 is jammed, the dry time 67 is set to a sufficient time to dry ink adhered to the front surface 64.

It is noted that double-sided image forming processes are not necessarily performed continuously. For example, a single-sided recording process may be performed between the double-sided record process on the third recording sheet 65 and the double-sided record process on the fourth recording sheet 65. That is, in this exemplary embodiment, the double-sided image forming processes for the seven recording sheets 65 are continuously performed in one job, but the present inventive concept is not limited thereto.

<Double-Sided Image Forming Process>

Next, a double-sided image forming process of the printer 11 will be described in detail.

Figure 10:
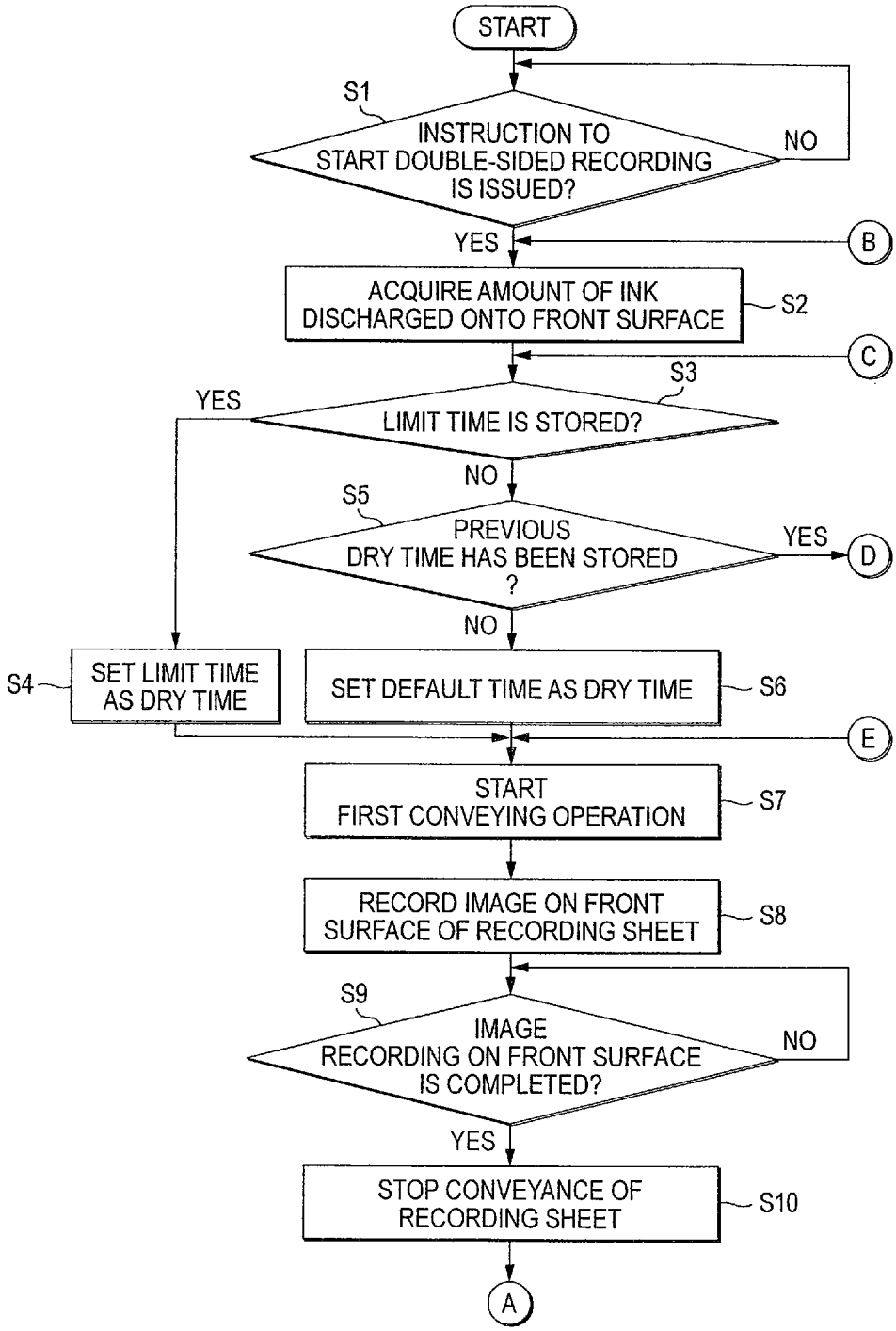
FIGS. 10 to 12 are a flowchart illustrating a process, according to an exemplary embodiment of the present invention, performed by the multifunction device when an instruction to start double-sided image forming is input.
Figure 11:
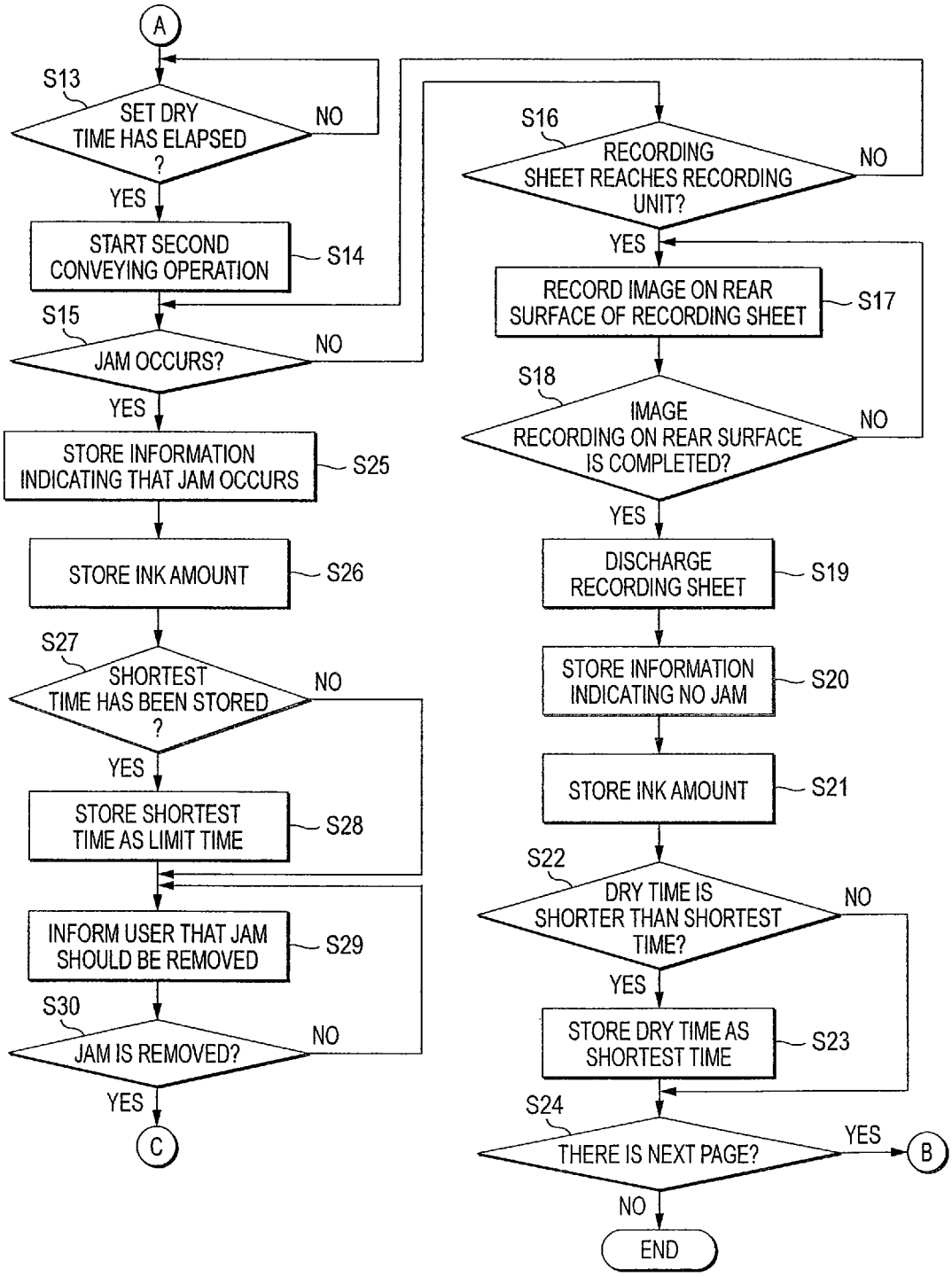
Figure 12:
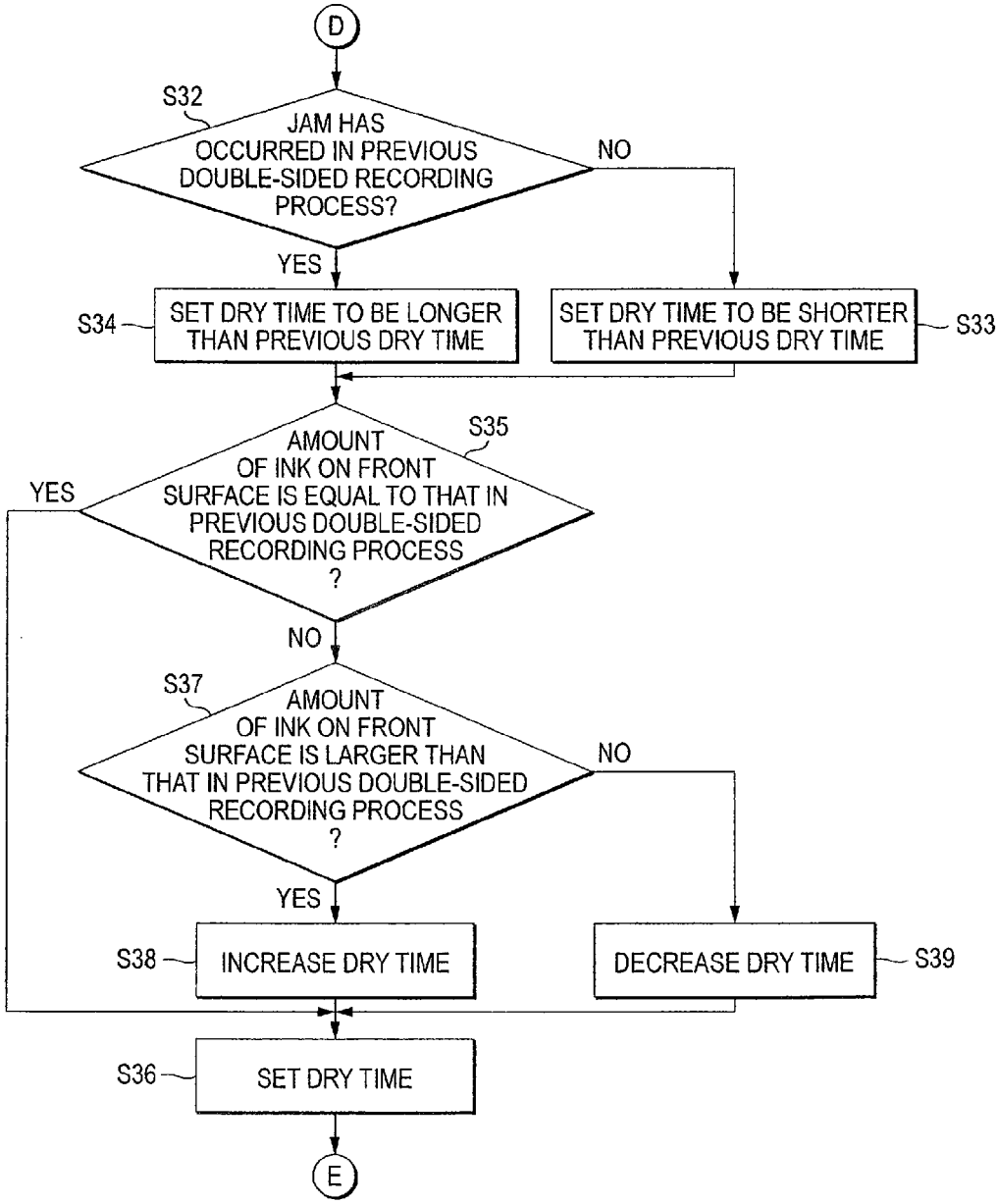

FIGS. 10 to 12 are flowcharts illustrating a process of the multifunction device 10 when an instruction to start the double-sided image forming process is input. The process of the multifunction device 10 described with reference to the following flowcharts is performed according to instructions of the control unit 70 that are issued on the basis of control programs stored in the ROM 72.

The control unit 70 of the multifunction device 10 determines whether an instruction to start the double-sided image forming process is issued on the basis of whether information is input through the control panel 14 (S1). If the control unit 70 determines that no instruction to start the double-sided image forming process is issued (S1: NO), the process returns to Operation S1. If it is determined that an instruction to start the double-sided image forming process is issued (S1: YES), the control unit 70 acquires an amount of ink discharged onto the front surface 64 of the recording sheet 65 in the current double-sided image forming (S2). Specifically, the control unit 70 controls the scanner 12 to scan the image of a document, thereby acquiring image data, generates print data on the basis of the image data, and stores the print data in the RAM 73. The control unit 70 acquires the amount of ink discharged from the inkjet head 41 of the image forming unit 24 onto the front surface 64 of the recording sheet 65 on the basis of the print data stored in the RAM 73.

Then, the control unit 70 determines whether a limit time is stored in the EEPROM 74 (S3). Specifically, the control unit 70 determines whether a limit time is stored in the 'limit time' field in the record in which the ink amount acquired in Operation S2 is stored in the 'ink amount' field, with reference to the limit time table 37. If it is determined that the limit time is stored (S3: YES), the control unit 70 sets the limit time as the dry time 67 (S4). Specifically, the control unit 70 reads a limit time corresponding to the ink amount acquired in Operation S2 from the limit time table 37, and stores the read time as the dry time 67 in the RAM 73. As such, the control unit 70 sets the limit time stored in the limit time table 37, which corresponds to the ink amount acquired in the current double-sided image forming process, as the dry time 67 of the current double-sided image forming process.

If it is determined that no limit time is stored (S3: NO), the control unit 70 determines whether the previous dry time 67 is stored in the RAM 73 (S5). If it is determined that the dry time 67 of the previous double-sided image forming process is not stored (S5: NO), the control unit 70 sets a default time as the dry time 67 in the current double-sided image forming process (S6). Specifically, the control unit 70 reads a default time corresponding to the ink amount acquired in Operation S2 from the default time table 35, and stores the read default time as the dry time 67 in the RAM 73.

After the control unit 70 performs Operation S4 or Operation S6, the control unit 70 starts the first conveying operation (S7) to record an image on a front surface of a recording sheet. That is, the control unit 70 controls the LF motor 77 of the transfer unit 15 to convey the recording sheet 65 along the first transfer path 22 with the front surface 64 facing the inkjet head 41 of the image forming unit 24. During the conveyance operation, the image forming unit 24 records an image on the front surface 64 of the recording sheet 65 (S8). Specifically, the head control circuit 81 controls the operation of the inkjet head 41 on the basis of input print data to selectively discharge ink from the inkjet head 41 to the front surface 64 of the recording sheet 65.

The control unit 70 determines whether image recording on the front surface 64 of the recording sheet 65 are completed (S9). If the control unit 70 determines that image recording on the front surface 64 of the recording sheet 65 is not completed (S9: NO), the process returns to Operation S9. If it is determined that image recording on the front surface 64 of the recording sheet 65 is completed (S9: YES), the control unit 70 controls the LF motor 77 to stop the conveyance of the recording sheet 65 (S10). In this way, the recording sheet 65 stops at the position shown in FIG. 4. The control unit 70 performs Operation S10, and then counts the time elapsed.

As shown in FIG. 11, after starting to count the time elapsed, the control unit 70 determines whether the dry time 67 has elapsed (S13). If the control unit 70 determines that the dry time 67 has not elapsed (S13: NO), the process returns to Operation S13. If it is determined that the dry time 67 has elapsed (S13: YES), the control unit 70 starts the second conveying operation (S14). In this way, the posture of the arm 55 is changed from the first posture (see FIG. 4) to the second posture (see FIG. 5), and the recording sheet 65 is switched back and conveyed along the second transfer path 23.

After the second conveying operation is started, the control unit 70 detects whether the recording sheet 65 is jammed on the basis of the sensor signal output from the range sensor 84 (S15). If it is determined that no jam is detected from the recording sheet 65 (S15: NO), the control unit 70 determines whether the recording sheet 65 reaches the image forming unit 24 (S16). Specifically, the control unit 70 determines whether the amount of conveyance of the recording sheet 65 after the range sensor 84 detects the tailing end 62 of the recording sheet 65 is larger than a threshold amount, on the basis of the encoder amount output from the rotary encoder 82. If it is determined that the amount of conveyance of the recording sheet 65 is smaller than the threshold amount, it is determined that the recording sheet 65 has not reached the image forming unit 24. On the other hand, if it is determined that the amount of conveyance of the recording sheet 65 is equal to or larger than the threshold amount, it is determined that the recording sheet 65 reaches the image forming unit 24.

If the control unit 70 determines that the recording sheet 65 has not reached the image forming unit 24 (S16: NO), the process returns to Operation S15. As described above, the recording sheet 65 is fed from the second transfer path 23 to the first transfer path 22 by the second conveying operation. As a result, the recording sheet 65 is conveyed to the image forming unit 24 with the front and rear surfaces thereof being reversed. If it is determined that the recording sheet 65 has reached the image forming unit 24 (S16: YES), the control unit 70 controls the image forming unit to record an image on the rear surface of the recording sheet 65 (S17). Specifically, the control unit 70 inputs print data to the head control circuit 81 to control the inkjet head 41 to selectively discharge ink onto the rear surface of the recording sheet 65.

The control unit 70 determines whether image recording on the rear surface of the recording sheet 65 has been completed (S18). If the control unit 70 determines that image recoding on the rear surface of the recording sheet 65 has not been completed (S18: NO), the process returns to Operation S17. If it is determined that image recording on the rear surface of the recording sheet 65 has been completed (S18: YES), the control unit 70 conveys the recording sheet 65 from the first transfer path 22 to the sheet discharging tray 21 (S19).

After images are completely recorded on both surfaces of the recording sheet 65, the control unit 70 stores information indicating no jam (S20). Specifically, the control unit 70 stores in the RAM 73 information indicating that the jam of the recording sheet 65 is has not been detected by the range sensor 84. Then, the control unit 70 stores in the RAM 73 the amount of ink discharged from the inkjet head 41 to the front surface 64 of the recording sheet 65 in the current double-sided image forming process (S21). That is, the control unit 70 stores the amount of ink acquired in Operation S2 as the ink amount 66 in the RAM 73. If the ink amount 66 has already been stored in the RAM 73, the ink amount acquired in Operation S2 overwrites the ink amount 66 that has been previously stored.

Then, the control unit 70 determines whether the dry time 67 set in the current double-sided image forming process is shorter than the shortest time (S22). Specifically, the control unit 70 reads from the shortest time table 36 the shortest time written in the 'shortest time' field in the record in which the ink amount 66 is stored in the 'ink amount' field, with reference to the shortest time table 36. Then, the control unit 70 determines whether the dry time 67 is shorter than the read shortest time. If it is determined that the dry time 67 is shorter than the read shortest time (S22: YES), the control unit 70 stores the dry time 67 as the shortest time (S23). Specifically, the control unit 70 stores the dry time 67 in the 'shortest time' field in the record in which the ink amount 66 is stored in the 'ink amount' field in the shortest time table 36. In this way, the read shortest time is updated to the dry time 67. Operation S23 may be performed without performing Operation S22. The process then proceeds with Operation S24.

If it is determined that the dry time 67 is not shorter than the read shortest time (S22: NO), the control unit 70 determines whether there is print data for a next page (S24). If the control unit 70 determines that there is print data of the next page (S24: YES), the process proceeds to Operation S2. If the control unit 70 determines that there is no print data of the next page (S24: NO), printing is completed, and the process ends.

Returning to Operation S15, if it is detected that the recording sheet 65 is jammed before image recording on the rear surface of the recording sheet 65 starts (S15: YES), the control unit 70 stores information indicating that a jam has occurred (S25). Specifically, the control unit 70 stores in the RAM 73 information indicating that the jam of the recording sheet 65 is detected by the range sensor 84. Then, the control unit 70 stores in the RAM 73 the amount of ink discharged from the inkjet head 41 to the front surface 64 of the recording sheet 65 in the current double-sided image forming process (S26). This process is performed in a similar manner as in Operation S21.

The control unit 70 determines whether the shortest time has been stored in the EEPROM 74 (S27). Specifically, the control unit 70 determines whether the shortest time is stored in the 'shortest time' field in the record in which the ink amount 66 is stored in the 'ink amount' field, with reference to the shortest time table 36. If it is determined that the shortest time is stored (S27: YES), the control unit 70 stores the shortest time as the limit time (S28). Specifically, the control unit 70 reads the shortest time from the 'shortest time' field in the record in which the ink amount 66 is stored in the 'ink amount' field, with reference to the shortest time table 36. Then, the control unit 70 stores the shortest time in the 'limit time' field in the record in which the ink amount 66 is stored in the 'ink amount' field in the limit time table 37. As such, if the range sensor 84 detects that a jam occurs, the control unit 70 stores the shortest time as the limit time in the EEPROM 74.

After Operation S28 is performed, or if it is determined that no shortest time has been stored (S27: NO), the control unit 70 indicates that it is necessary to remove the paper jam (S29). Specifically, the control unit 70 displays a message 'Paper jam' or 'Open the cover and remove the paper jam' on the control panel 14. Then, the control unit 70 determines whether the paper jam is removed (i.e., whether the jammed recording sheet 65 is removed) using a known method (S30). If the control unit 70 determines that the paper jam is not removed (S30: NO), the process returns to Operation S29. If the control unit 70 determines that the paper jam is removed (S30: YES), the process proceeds to Operation S3.

Returning to Operation S5, if the control unit 70 determines that the previous dry time 67 is stored in the RAM 73 (S5: YES), the process proceeds to Operation S32 (see FIG. 12). The control unit 70 determines whether a jam has occurred in the previous process of recording an image on the rear surface on the basis of information indicating the occurrence conditions of the jam that is stored in the RAM 73 (e.g., information stored in the RAM 73 at Operation S20 or Operation S25) (S32). More specifically, if Operation S20 has been performed in a previous double-sided image forming process, the determination result in Operation S32 is 'NO'. On the other hand, if Operation S25 has been performed in the previous double-sided image forming process, the determination result in Operation S32 is 'YES'.

If it is determined that no jam has occurred in the previous process of recording an image on the rear surface (S32: NO), the control unit 70 makes the dry time shorter than the previous dry time (S33). Specifically, the control unit 70 reads the previous dry time 67 from the RAM 73, and decreases the dry time 67.

If it is determined that a jam has occurred in the previous process of recording an image on the rear surface (S32: YES), the control unit 70 makes the dry time longer than the previous dry time (S34). Specifically, the control unit 70 reads the previous dry time 67 from the RAM 73, and increases the dry time 67. Operation S33 and Operation S34 are performed on the basis of for example, a mathematical expression.

The control unit 70 determines whether the amount of ink discharged to the front surface 64 of the recording sheet 65 in the current double-sided image forming process is equal to the amount of ink discharged to the front surface 64 of the recording sheet 65 in the previous double-sided image forming process (S35). Specifically, the control unit 70 determines whether the current ink amount acquired in Operation S2 is equal to the previous ink amount 66 stored in the RAM 73. If it is determined the current ink amount on the front surface 64 is equal to the previous ink amount (S35: YES), the control unit 70 stores the dry time changed in Operation S33 or Operation S34 as the dry time 67 in the RAM 73 (S36). That is, if the range sensor 84 detects that no jam has occurred in the recording sheet 65 in the previous double-sided image forming process (i.e., the determination result in Operation S32 is 'NO'), the control unit 70 sets the dry time in the current double-sided image forming process to be shorter than the dry time 67 in the previous double-sided image forming process. On the other hand, if the range sensor 84 detects that a jam has occurred in the recording sheet 65 in the previous double-sided image forming process (i.e., the determination result in Operation S32 is 'YES'), the control unit 70 sets the dry time in the current double-sided image forming process to be longer than the dry time 67 in the previous double-sided image forming process.

If it is determined that the current ink amount on the front surface 64 is different from the previous ink amount (S35: NO), the control unit 70 determines whether the ink amount on the front surface 64 is larger than the previous ink amount (S37). Specifically, the control unit 70 determines whether the current ink amount acquired in Operation S2 is larger than the previous ink amount 66 stored in the RAM 73. If it is determined that the current ink amount on the front surface 64 is larger than the previous ink amount (S37: YES), the control unit 70 increases the dry time changed in Operation S33 or Operation S34 (S38).

If it is determined that the current ink amount on the front surface 64 is smaller than the previous ink amount (S37: NO), the control unit 70 decreases the dry time changed in Operation S33 or Operation S34 (S39). Operation S38 and Operation S39 are performed on the basis of, for example, a mathematical expression.

As such, if the current ink amount on the front surface 64 is different from the previous ink amount, the control unit 70 stores the dry time changed in Operation S38 or Operation S39 as the dry time 67 in the RAM 73 (S36). That is, if the ink amount acquired in the current double-sided image forming process is larger than the ink amount 67 acquired in the previous double-sided image forming process (i.e., the determination result in Operation S37 is 'YES'), the control unit 70 sets the dry time in the current double-sided image forming process to be longer than the dry time in the previous double-sided image forming process. On the other hand, if the ink amount acquired in the current double-sided image forming process is smaller than the ink amount 67 acquired in the previous double-sided image forming process (i.e., the determination result in Operation S37 is 'NO'), the control unit 70 sets the dry time in the current double-sided image forming process to be smaller than the dry time in the previous double-sided image forming process.

As described above, the control unit 70 sets the dry time 67 for the recording sheet 65 used in the current double-sided image forming process on the basis of the jam detection result of the recording sheet 65 used in the previous double-sided image forming process by the range sensor 84 and the ink amount on the front surface 64 acquired by the control unit 70. However, the dry time in the current double-sided image forming process may be set on the basis of only the detection result (i.e., the occurrence conditions of the jam) of the recording sheet 65 used in the previous double-sided-image forming process by the range sensor 84. In such a case, Operation S35, and Operations S37 to Operation S39 are not needed.

<Operations and Effects>

The dry time for the recording sheet 65 used in the current double-sided image forming process is set on the basis of the detection result of the recording sheet 65 used in the previous double-sided image forming process by the range sensor 84. That is, if a jam is detected in the previous double-sided image forming process, the dry time in the current double-sided image forming process is set to be longer than the previous dry time. On the other hand, if no jam is detected in the previous double-sided image forming process, the dry time in the current double-sided image forming process is set to be shorter than the previous dry time. That is, if a jam is detected in the previous double-sided image forming process, the dry time in the current double-sided image forming process is set to be longer than that in the previous double-sided image forming process, which makes it possible to prevent the occurrence of a jam in the current double-sided image forming process. On the other hand, assuming that a jam is less likely to occur even though the dry time is short (i.e., if no jam is detected in the previous double-sided image forming process), the dry time is shorter than that in the previous double-sided image forming process, and the time to perform the double-sided image forming process is shortened. As such, since the dry time is set on the basis of whether a jam occurs in the recording sheet 65 in the previous double-sided image forming process, it is possible to set a sufficiently long dry time to reduce the occurrence of a jam. As a result, it is possible to shorten the time to perform double-sided image forming while preventing the occurrence of a jam.

The time to dry the ink adhered to the front surface 64 of the recording sheet 65 depends on the amount of ink discharged from the inkjet head 41 to the front surface 64. That is, the larger the amount of ink adhered to the front surface 64, the longer the time used to dry the ink. On the other hand, the smaller the amount of ink adhered to the front surface 64, the shorter the time used to dry the ink. Accordingly, if the amount of ink adhered to the front surface 64 of the recording sheet 65 used in the current double-sided image forming process is larger than the amount of ink adhered to the front surface 64 of the recording sheet 65 used in the previous double-sided image forming process, the dry time is set to be longer than that in the previous double-sided image forming process, and the occurrence of a jam is prevented. On the other hand, if the amount of ink adhered to the front surface 64 of the recording sheet 65 used in the current double-sided image forming process is smaller than the amount of ink adhered to the front surface 64 of the recording sheet 65 used in the previous double-sided image forming process, the dry time is set to be shorter than that in the previous double-sided image forming process, and the time for double-sided image forming is shortened. As such, the dry time is set on the basis of the amount of ink discharged from the inkjet head 41 of the image forming unit 24 to the front surface 64 of the recording sheet 65 in addition to the jam occurrence conditions of the recording sheet 65. Therefore, it is possible to set an optimum dry time, as compared to if the dry time is set on the basis of only the jam occurrence conditions of the recording sheet 65.

In the double-sided image forming process after a jam occurs, the dry time is set to the shortest time (i.e., a limit time) when a jam is less likely to occur in the double-sided image forming process that is performed with substantially the same ink amount as that in the previous double-sided image forming process in which a jam has occurred, with reference to the limit time table 37. Specifically, the dry time in the current double-sided image forming process is set to be longer than that in the previous double-sided image forming process in which a jam has occurred, and is also set to the shortest time among the dry times when no jam occurs. Therefore, it is possible to an optimum dry time for completing double-sided image forming as short as possible without a jam caused by an excessively short dry time, according to the amount of ink.

<Modifications>

Figure 13A:
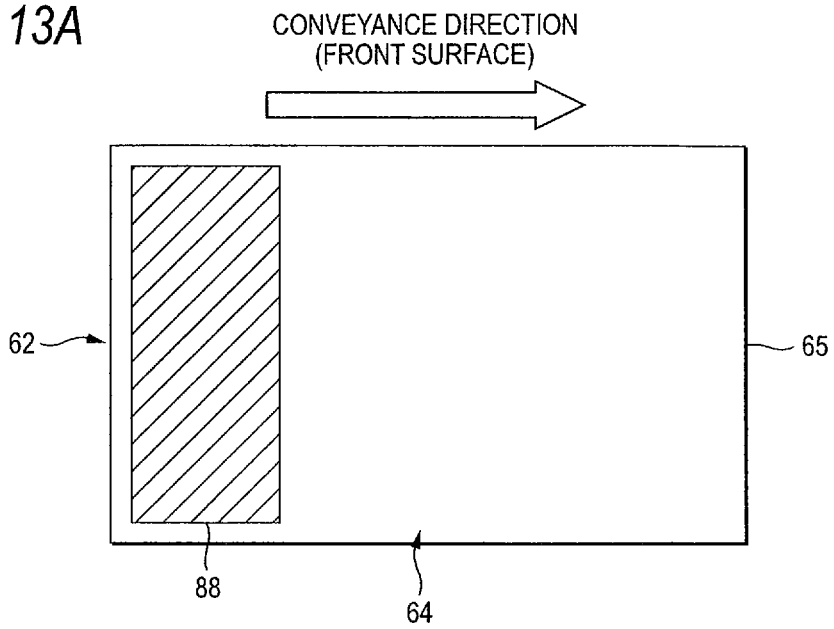
FIGS. 13A and 13B are diagrams schematically illustrating a front surface of the recording sheet.
Figure 13B:
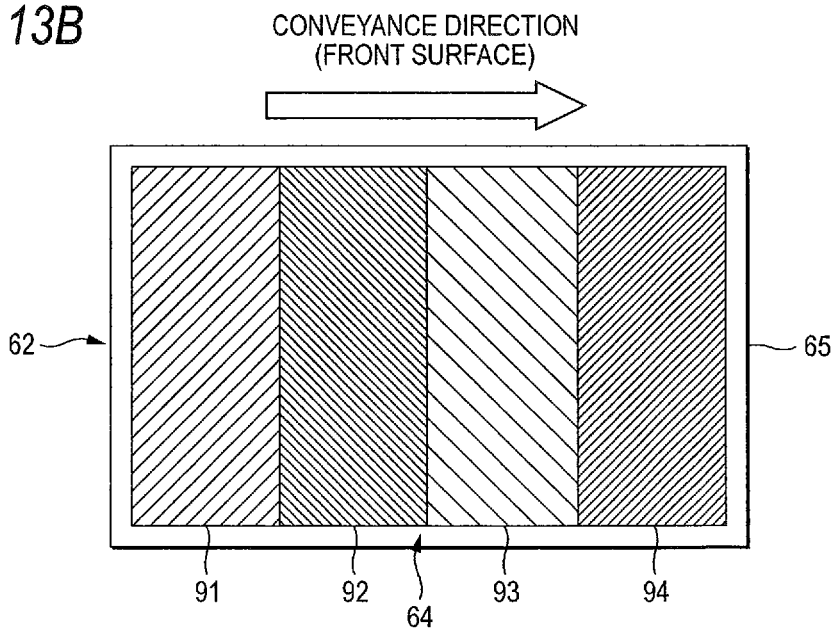

FIGS. 13A and 13B are diagrams schematically illustrating a front surface 64 of a recording sheet 65. Specifically, FIG. 13A shows an area 88, and FIG. 13B shows areas 91 to 94.

As described above, after the dry time 67 has elapsed after the first conveying operation of the recording sheet 65, the recording sheet 65 is switched back and conveyed along the second transfer path 23, with the trailing end 62 facing the second transfer path (see FIG. 5). Then, the recording sheet 65 is conveyed to the contact position between the uppermost one of the recording sheets on the sheet feed tray 20 and the feed roller 25, with the trailing end 62 facing the contact position. That is, the recording sheet 65 is conveyed to the position where it is assumed that a jam occurs, with the trailing end 62 facing the position where the jam occurs. Therefore, in the front surface 64 of the recording sheet 65, the dry conditions of ink in the area 88 (see FIG. 13A) in the vicinity of the trailing end 62 have a greater affect on the occurrence of a jam. In other words, if a sheet has a large amount of ink ejected at the trailing end 62 of the recording sheet 65 during front side image recording, the recording sheet 65 will be more likely to jam because the trailing end becomes the leading end once the conveyance direction is reversed to print on the back of the recording sheet.

Accordingly, as shown in FIG. 13A, in another exemplary embodiment of the present invention, the control unit 70 divides the front surface 64 of the recording sheet 65 into a plurality of areas. For example, in FIG. 13A, the front surface 64 is divided into an area 88 and a remaining area (i.e., the white space in FIG. 13A). In this case, the control unit 70 divides the front surface 64 of the recording sheet 65 into a plurality of areas, on the basis of the encoder amount output from the rotary encoder 82. The control unit 70 acquires the amount of ink from each of the divided areas, on the basis of print data, and sets the amount of ink discharged from the inkjet head 41 to the area 88 as the ink amount 66. In this way, the control unit can set the dry time 67 on the basis of the amount of ink discharged to the area 88 that has more affect on the occurrence conditions and the occurrence of a jam. In this case, in another exemplary embodiment of the present invention, the ink amount in the 'ink amount' field of each of the tables 35 to 37 may correspond to the amount of ink discharged to, for example, the area 88.

Further, the front surface 64 may also be divided into a plurality of areas in the direction in which the recording sheet 65 is conveyed, a weight may be assigned to each area having ink discharged therein, and the total amount of ink may be set as the ink amount 66. For example, as shown in FIG. 13B, the control unit 70 may divide the front surface 64 of the recording sheet 65 into, for example, four areas 91 to 94 in the conveyance direction. Then, the control unit 70 calculates the total amount of ink using an expression such as: 'the amount of ink in the area 94×0.1+the amount of ink in the area 93×0.2+the amount of ink in the area 92×0.3+the amount of ink in the area 91×0.4'. Then, the control unit 70 sets the calculated value as the ink amount 66. As such, a larger weight is assigned to the area or areas that have a greater effect on the occurrence of a jam. The number of areas divided and weights assigned to the divided areas may be appropriately changed.

As described above, it is possible to set an optimum dry time by determining the dry time in consideration of the amount of ink discharged to the area 88 that has a greater effect on the occurrence of a jam or by assigning weights to the amounts of ink discharged to the areas 91 to 94 on the basis of the degree of the influence.

Furthermore, in the above-described exemplary embodiments, the recording sheet 65 subjected to the first conveying operation stands by at a certain position, but the invention is not limited thereto. The recording sheet 65 may be conveyed before the dry time 67 elapses after the first conveying operation has been completed. That is, in the above-described exemplary embodiments, since it is assumed that a jam occurs at the contact position between the feed roller 25 and the uppermost one of the recording sheets on the sheet feed tray 20, the recording sheet 65 may be conveyed for the period. That is, the second conveying operation conveys the recording sheet 65 at a position that is closer to the image forming unit 24 than the position where it is assumed that a jam occurs.

Further, the second conveying operation according to exemplary embodiments of the present invention is not limited to the operation of conveying the recording sheet 65 having an image formed on the front surface thereof from the first transfer path 22 to the sheet discharging tray 21 after the posture of the arm 55 is changed from the first posture to the second posture. The second conveying operation may convey the recording sheet 65 to the first transfer path 22 again after the trailing end 62 of the recording sheet 65 reaches the contact position. That is, the operation of switching back and conveying the recording sheet 65 along the second transfer path 23 may be performed before the dry time 67 elapses after the first conveying operation has been completed, or before the second conveying operation starts after the dry time 67 has elapsed.

Furthermore, in the above-described exemplary embodiments, the control unit 70 detects whether the recording sheet 65 is jammed on the basis of the sensor signal output from the range sensor 84, but a method of detecting the jam is not limited thereto. For example, a media sensor may be mounted on the carriage 40, and the control unit may detect whether the recording sheet 65 subjected the second conveying operation is jammed on the basis of sensor signals output from the range sensor 84 and the media sensor. The media sensor may be, for example, an optical sensor that detects the leading end and the trailing end 62 of the recording sheet 65 conveyed to the platen 42 and both ends of the recording sheet 65 in the width direction (a direction vertical to the plane of FIG. 3).

According to an exemplary embodiment of the present invention, a double-sided image forming apparatus includes an image forming unit that discharges ink onto a sheet to record an image on the sheet; a transfer unit that performs a first conveying operation of conveying the sheet with a first surface thereof facing the image forming unit and a second conveying operation of conveying the sheet with a second surface thereof facing the image forming unit after the first conveying operation; a detecting unit that detects a jam of the sheet subjected to the second conveying operation; a setting unit that sets a dry time required to dry the ink discharged onto the first surface of the sheet by the image forming unit; and a control unit that controls the transfer unit to start the second conveying operation after the dry time has elapsed after the first conveying operation. The setting unit sets the dry time for the sheet used in a current double-sided image forming process on the basis of the detection result of the sheet used in a previous double-sided image forming process by the detecting unit.

For example, the sheet accommodated in the sheet feed tray is subjected to the first conveying operation by the transfer unit. In this way, the sheet is conveyed along a transfer path with the first surface thereof facing the image forming unit. While the recording sheet is conveyed, the image forming unit discharges ink onto one surface (first surface) of the sheet to record an image on the recording sheet. The sheet subjected to the first conveying operation is subjected to the second conveying operation by the transfer unit. Then, the sheet is conveyed again along a predetermined transfer path with the second surface thereof facing the image forming unit. While the sheet is conveyed, the image forming unit discharges ink onto the other surface (second surface) of the sheet to record an image on the other surface of the sheet. In this way, images are recorded on both surfaces of the sheet.

In the double-sided image forming apparatus, the setting unit sets the dry time until the first conveying operation is completed. The dry time is a time to dry ink discharged onto the first surface of the sheet by the image forming unit. The transfer unit is controlled by the control unit. In this way, the sheet stands by at a certain position before the dry time elapses after the first conveying operation has been completed. The standby is not limited to the stop of the sheet. That is, for the above-mentioned period, the sheet may be conveyed to the position where it is assumed that a jam occurs. The second conveying operation is to convey the sheet at the position that is closer to the image forming unit than the position where it is assumed that a jam occurs. After the dry time has elapsed, the transfer unit starts the second conveying operation, and an image is recorded on the second surface of the sheet. When the second conveying operation starts, the detecting unit detects whether a jam occurs in the sheet conveyed by the second conveying operation. The detecting unit detects that a jam occurs in each sheet having images recorded on both surfaces thereof The dry time for the sheet used in the current double-sided image forming process is set on the basis of the detection result of the sheet used in the previous double-sided image forming process by the detecting unit. In this way, it is possible to set a dry time on the basis of whether a jam occurs If the detecting unit has detected that no jam occurs in the sheet used in the previous double-sided image forming process, the setting unit may set the dry time in the current double-sided image forming process to be shorter than that in the previous double-sided image forming process.

According to the above-mentioned structure, assuming that a jam is less likely to occur even though the dry time is short, the dry time is set to be shorter than that in the previous double-sided image forming process. Therefore, it is possible to shorten the time for double-sided image forming.

If the detecting unit has detected that a jam occurs in the sheet used in the previous double-sided image forming process, the setting unit may set the dry time in the current double-sided image forming process to be longer than that in the previous double-sided image forming process.

According to the above-mentioned structure, assuming that a jam is more likely to occur for the previous dry time, the dry time is set to be longer than that in the previous double-sided image forming process. Therefore, it is possible to prevent the occurrence of a jam.

The double-sided image forming apparatus according to the above-mentioned aspect may further include a storage unit that, if the detecting unit detects that the jam occurs, stores as a limit time the shortest dry time when the detecting unit has detected that no jam occurs in the previous double-sided image forming process. The setting unit may set, as the limit time, the dry time in a double-sided image forming process after the detecting unit detects that a jam occurs.

According to the above-mentioned structure, in the double-sided image forming process after a jam occurs, the shortest time (limit time) when a jam is less likely to occur is set as the dry time. Therefore, it is possible to complete a double-sided image forming process in the shortest time without a jam caused by an excessively short dry time.

The double-sided image forming apparatus according to the above-mentioned aspect may further include an acquiring unit that acquires the amount of ink discharged from the image forming unit to the first surface of the sheet, and the setting unit may set the dry time in the current double-sided image forming process on the basis of the detection result by the detecting unit and the amount of ink acquired by the acquiring unit.

The time to dry ink adhered to the first surface of the sheet depends on the amount of ink discharged onto the first surface. That is, the larger the amount of ink adhered to the first surface becomes, the longer the time used to dry the ink becomes. On the other hand, the smaller the amount of ink adhered to the first surface becomes, the shorter the time used to dry the ink becomes. According to the above-mentioned structure, the dry time is set on the basis of the amount of ink discharged from the image forming unit to the first surface of the sheet as well as the occurrence conditions of a jam. Therefore, it is possible to set an optimum dry time.

The double-sided image forming apparatus according to the above-mentioned aspect may further include an acquiring unit that acquires the amount of ink discharged from the image forming unit to the first surface of the sheet. The storage unit may store the limit time so as to be associated with the amount of time acquired by the acquiring unit, and the setting unit may set the limit time corresponding to the amount of ink acquired by the acquiring unit in the current double-sided image forming process as the dry time in the current double-sided image forming process.

According to the above-mentioned structure, after a jam occurs, the dry time is set to the shortest time (limit time) when a jam is less likely to occur in the double-sided image forming process that is performed with the same amount of ink that in the previous double-sided image forming process in which the jam occurs. That is, an optimum dry time corresponding to the amount of ink is set.

If the amount of ink acquired by the acquiring unit in the current double-sided image forming process is smaller than that in the previous double-sided image forming process, the setting unit may set the dry time in the current double-sided image forming process to be shorter than that in the previous double-sided image forming process.

According to the above-mentioned structure, assuming that ink adhered to the first surface of the sheet is sufficiently dried even though the dry time is short, the dry time is set to be shorter than that in the previous double-sided image forming process. Therefore, it is possible to shorten the time used for double-sided image forming.

If the amount of ink acquired by the acquiring unit in the current double-sided image forming process is larger than that in the previous double-sided image forming process, the setting unit may set the dry time in the current double-sided image forming process to be longer than that in the previous double-sided image forming process.

According to the above-mentioned structure, assuming that ink adhered to the first surface of the sheet is not sufficiently dried for the previous dry time, the dry time is set to be longer than that in the previous double-sided image forming process. Therefore, it is possible to prevent the occurrence of a jam.

The double-sided image forming apparatus according to the above-mentioned aspects may further include a dividing unit that divides the first surface of the sheet into a plurality of areas. The acquiring unit may acquire the amount of ink from each of the areas divided by the dividing unit According to the above-mentioned structure, it is possible to set an optimum dry time in consideration of the amount of ink adhered to an area that has a large effect on the occurrence of a jam.

According to the above-mentioned aspects of the exemplary, the dry time is set on the basis of whether a jam occurs. Therefore, it is possible to set an accurate dry time.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

an image forming unit configured to discharge ink onto a sheet to form an image on the sheet;

a transfer unit configured to perform a first conveying operation of conveying the sheet in a state in which a first surface thereof faces the image forming unit, and a second conveying operation of conveying the sheet in a state in which a second surface thereof faces the image forming unit after the first conveying operation;

a detecting unit configured to detect whether a jam of the sheet subjected to the second conveying operation occurred;

a setting unit configured to set a dry time for drying the ink discharged onto the first surface of the sheet, and wherein the setting unit sets the dry time for a current sheet;

a control unit configured to control the transfer unit to start the second conveying operation after the dry time has elapsed after the first conveying operation;

an acquiring unit configured to acquire, as an acquired amount of ink, an amount of ink discharged from the image forming unit onto the first surface of the sheet;

a storage unit configured to store a plurality of default times and a plurality of amounts of ink, each of the default times being associated with one of the amounts of ink, and one of the amounts of ink corresponding to the acquired amount of ink, wherein the control unit controls the storage unit to further store:

a plurality of shortest times, each of which is associated with one of the amounts of ink, a plurality of limit times, each of which is associated with one of the amounts of ink, a previous dry time, which is a dry time for drying the ink discharged onto the first surface of a previous sheet, a previous ink amount, which is an amount of ink discharged to the first surface of the previous sheet, a jam detection result, which is a result of the detecting unit detecting whether the jam occurred in the previous sheet, and a provisional dry time, which is a dry time based on the previous dry time and the jam detection result, wherein the control unit is further configured to determine whether one of the limit times stored in the storage unit is associated with the one of the amounts of ink that corresponds to the acquired amount of ink, wherein, when the control unit determines that one of the limit times stored in the storage unit is associated with the one of the amounts of ink that corresponds to the acquired amount of ink, the setting unit sets said one of the limit times as the dry time for the current sheet, wherein, when the control unit determines that none of the limit times stored in the storage unit is associated with the one of the amounts of ink that corresponds to the acquired amount of ink and the previous dry time is not stored in the storage unit, the setting unit sets the one of the default times that is associated with the one of the amounts of ink that corresponds to the acquired amount of ink as the dry time for the current sheet, wherein, when the control unit determines that none of the limit times stored in the storage unit is associated with the one of the amounts of ink that corresponds to the acquired amount of ink and the previous dry time is stored in the storage unit, the control unit determines whether the detecting unit detects the jam of the previous sheet according to the jam detection result, wherein, when the control unit determines according to the jam detection result that the jam did not occur in the previous sheet, the control unit sets the provisional dry time to be less than the previous dry time, wherein, when the control unit determines according to the jam detection result that the jam did occur in the previous sheet, the control unit sets the provisional dry time to be greater than the previous dry time, wherein, after the control unit sets the provisional dry time, the control unit determines whether the amount of ink discharged to the first surface of the current sheet is equal to the previous ink amount of the previous sheet, wherein, when the control unit determines that the amount of ink discharged to the first surface of the current sheet is equal to the previous ink amount of the previous sheet, the setting unit sets the dry time for the current sheet to be equal to the provisional dry time, wherein, when the control unit determines that the amount of ink discharged to the first surface of the current sheet is not equal to the previous ink amount of the previous sheet, the control unit determines whether the amount of ink discharged to the first surface of the current sheet is greater than the previous ink amount of the previous sheet, wherein, when the control unit determines that the amount of ink discharged to the first surface of the current sheet is greater than the previous ink amount of the previous sheet, the setting unit sets the dry time for the current sheet to be greater than the provisional dry time, wherein, when the control unit determines that the amount of ink discharged to the first surface of the current sheet is less than the previous ink amount of the previous sheet, the setting unit sets the dry time for the current sheet to be less than the provisional dry time, wherein, when the detecting unit does not detect the jam of the current sheet and the dry time for the current sheet is less than the one of the shortest times that is associated with the one of the amounts of ink that corresponds to the acquired amount of ink, the control unit controls the storage unit to store the dry time for the current sheet as said one of the shortest times, and wherein, when the detecting unit detects the jam of the current sheet and one of the shortest times stored in the storage unit is associated with the one of the amounts of ink that corresponds to the acquired amount of ink, the control unit controls the storage unit to store said one of the shortest times as the one limit time associated with the one of the amounts of ink that corresponds to the acquired amount of ink.

2. The image forming apparatus according to claim 1, wherein the setting unit sets the dry time for the current sheet on the basis of the detection result detected by the detecting unit and the amount of ink acquired by the acquiring unit.

3. The image forming apparatus according to claim 2, further comprising:

a dividing unit that divides the first surface of the sheet into a plurality of areas, wherein the acquiring unit acquires the amount of ink from at least one of the plurality of areas.

4. The image forming apparatus according to claim 3, wherein the acquiring unit acquires the amount of ink based on an amount of ink used in each of the plurality of areas.

5. The image forming apparatus according to claim 3, wherein the acquiring unit acquires the amount of ink from an area adjacent to a first edge portion of the sheet, which passes through a contact point before a second edge portion of the sheet in the second conveying operation.

6. The image forming apparatus according to claim 4, wherein the setting unit assigns a weight value to each of the plurality of areas and the acquiring unit acquires the amount of ink based on an amount of ink used in each of the plurality of areas and the weight value assigned to each of the plurality of areas, and wherein the setting unit assigns a greater weight value to an area adjacent to the first edge portion of the sheet, which passes through a contact point before the second edge portion of the sheet in the second conveying operation, than an area adjacent to the second edge portion the sheet.

7. The image forming apparatus according to claim 1, wherein the dry time is a period of time between the first conveying operation and the second conveying operation, during which the sheet not conveyed.

8. The image forming apparatus according to claim 7, wherein the transfer unit changes a conveying direction of the sheet when the second conveying operation begins after the dry time.

9. The image forming apparatus according to claim 1, further comprising a sheet feeding tray configured to store the sheet, wherein the transfer unit comprises a feed roller configured to feed the sheet from the sheet feed tray, and wherein the sheet is conveyed by the transfer unit in the second conveying operation to pass through a contact point between the sheet feed tray and the feed roller.

10. A method comprising:

conveying a current sheet through a first conveyance path;

printing a first image on a first surface of the current sheet;

setting a dry time for the current sheet with a setting unit;

waiting for the dry time to elapse;

conveying the current sheet to a second conveyance path;

determining whether at least one of a previous sheet and the current sheet jammed;

printing a second image on a second surface of the current sheet;

acquiring, as an acquired amount of ink, an amount of ink discharged onto the first surface of the current sheet;

storing a plurality of default times and a plurality of amounts of ink in a storage unit, each of the default times being associated with one of the amounts of ink, and one of the amounts of ink corresponding to the acquired amount of ink;

controlling the storage unit with a control unit to further store:

a plurality of shortest times, each of which is associated with one of the amounts of ink, a plurality of limit times, each of which is associated with one of the amounts of ink, and a jam detection result, which is a result of determining whether the current sheet is jammed;

determining with the control unit whether one of the limit times stored in the storage unit is associated with the one of the amounts of ink that corresponds to the acquired amount of ink;

when the control unit determines that one of the limit times stored in the storage unit is associated with the one of the amounts of ink that corresponds to the acquired amount of ink, setting with the setting unit said one of the limit times as the dry time for the current sheet;

when the control unit determines that none of the limit times stored in the storage unit is associated with the one of the amounts of ink that corresponds to the acquired amount of ink and a previous dry time, which is a dry time for drying the ink discharged onto the first surface of the previous sheet, is not stored in the storage unit, setting with the setting unit the one of the default times that is associated with the one of the amounts of ink that corresponds to the acquired amount of ink as the dry time for the current sheet;

when the control unit determines that none of the limit times stored in the storage unit is associated with the one of the amounts of ink that corresponds to the acquired amount of ink and the previous dry time is stored in the storage unit, the determining with the control unit whether the detecting unit detects the jam of the previous sheet according to the jam detection result;

when the control unit determines according to the jam detection result that the jam did not occur in the previous sheet, setting with the control unit a provisional dry time to be less than the previous dry time;

when the control unit determines according to the jam detection result that the jam did occur in the previous sheet, setting with the control unit the provisional dry time to be greater than the previous dry time;

after the control unit sets the provisional dry time, determining with the control unit whether the amount of ink discharged to the first surface of the current sheet is equal to a previous amount of ink discharged to the first surface of the previous sheet;

when the control unit determines that the amount of ink discharged to the first surface of the current sheet is equal to the previous amount of ink discharged to the first surface of the previous sheet, setting with the setting unit the dry time for the current sheet to be equal to the provisional dry time;

when the control unit determines that the amount of ink discharged to the first surface of the current sheet is not equal to the previous amount of ink discharged to the first surface of the previous sheet, determining with the control unit whether the amount of ink discharged to the first surface of the current sheet is greater than the previous amount of ink discharged to the first surface of the previous sheet;

when the control unit determines that the amount of ink discharged to the first surface of the current sheet is greater than the previous amount of ink discharged to the first surface of the previous sheet, setting with the setting unit the dry time for the current sheet to be greater than the provisional dry time;

when the control unit determines that the amount of ink discharged to the first surface of the current sheet is less than the previous amount of ink discharged to the first surface of the previous sheet, setting with the setting unit the dry time for the current sheet to be less than the provisional dry time;

when it is determined that the current sheet is not jammed and the dry time for the current sheet is less than the one of the shortest times that is associated with the one of the amounts of ink that corresponds to the acquired amount of ink, controlling the storage unit with the control unit to store the dry time for the current sheet as said on of the shortest times; and when it is determined that the current sheet is jammed and one of the shortest times stored in the storage unit is associated with the one of the amounts of ink that corresponds to the acquired amount of ink, controlling the storage unit with the control unit to store said one of the shortest times as the one the limit time associated with the one of the amounts of ink that corresponds to the acquired amount of ink.

11. The method according to claim 10 further comprising:

feeding the first sheet from a sheet feed tray to a first conveyance path by a feed roller, wherein the sheet is conveyed in the second conveying path to pass through a contact point between the sheet feed tray and the feed roller.

* * * * *